US007909326B2

(12) United States Patent
Walker et al.

(10) Patent No.: US 7,909,326 B2
(45) Date of Patent: Mar. 22, 2011

(54) SYSTEMS, PRODUCTS AND PROCESSES FOR CONDUCTING INSTANT LOTTERY GAMES

(75) Inventors: Jay S. Walker, Ridgefield, CT (US); Michael W. Patterson, New York, NY (US); James A. Jorasch, Westport, CT (US)

(73) Assignee: Walker Digital, LLC, Stamford, CT (US)

( * ) Notice: Subject to any disclaimer, the term of this patent is extended or adjusted under 35 U.S.C. 154(b) by 112 days.

(21) Appl. No.: 11/814,763

(22) PCT Filed: Nov. 22, 2006

(86) PCT No.: PCT/US2006/061215

§ 371 (c)(1), (2), (4) Date: Jul. 25, 2007

(87) PCT Pub. No.: WO2007/062398

PCT Pub. Date: May 31, 2007

(65) Prior Publication Data

US 2009/0309352 A1 Dec. 17, 2009

Related U.S. Application Data

(60) Provisional application No. 60/739,259, filed on Nov. 22, 2006, provisional application No. 60/739,111, filed on Nov. 22, 2006.

(51) Int. Cl.
*A63F 3/06* (2006.01)

(52) U.S. Cl. ..... 273/139; 273/269; 283/901; 283/903

(58) Field of Classification Search ..... 273/139, 273/269, 901, 903; 283/901, 903
See application file for complete search history.

(56) References Cited

U.S. PATENT DOCUMENTS

| | | | | |
|---|---|---|---|---|
| 3,068,010 | A * | 12/1962 | Hagopian | 273/295 |
| 5,401,032 | A * | 3/1995 | Barnhart et al. | 273/293 |
| 5,657,991 | A * | 8/1997 | Camarato | 273/269 |
| 5,779,274 | A * | 7/1998 | Gallagher et al. | 283/49 |
| 5,988,688 | A | 11/1999 | Such | 283/100 |
| 6,234,477 | B1 | 5/2001 | Scrymgeour et al. | |
| 6,612,576 | B1 | 9/2003 | Stanik et al. | 273/139 |
| 6,656,042 | B2 | 12/2003 | Reiss et al. | 463/17 |
| 6,698,755 | B2 | 3/2004 | Cherry | 273/139 |
| 6,761,633 | B2 | 7/2004 | Riendeau et al. | 463/16 |
| 7,128,319 | B2 | 10/2006 | Finocchio | 273/139 |
| 2003/0116916 | A1 | 6/2003 | Cherry | |
| 2003/0184012 | A1 | 10/2003 | Green | |
| 2004/0204221 | A1 | 10/2004 | Eklund | |

(Continued)

OTHER PUBLICATIONS

PCT International Search Report for Application No. PCT/US06/61215 mailed Jan. 9, 2008, 5 pp.

(Continued)

*Primary Examiner* — Benjamin H Layno
(74) *Attorney, Agent, or Firm* — Fincham Downs LLC; Michael D. Downs

(57) ABSTRACT

Methods, systems and apparatus are described for producing lottery products and conducting lottery games. In one embodiment, a method for producing a lottery product comprises producing a lottery sub-product that includes a concealed indication of a redemption value of a different lottery sub-product. In one embodiment, a storybook allows a player to win by matching words from a paytable to revealable dialog or other story elements on a respective page of the storybook.

32 Claims, 53 Drawing Sheets

U.S. PATENT DOCUMENTS

| | | | | |
|---|---|---|---|---|
| 2005/0127662 | A1 | 6/2005 | Friesen et al. | 283/49 |
| 2005/0140092 | A1 | 6/2005 | Solano | |
| 2005/0233797 | A1 | 10/2005 | Gilmore | |
| 2006/0022451 | A1 | 2/2006 | Friesen et al. | 283/53 |

OTHER PUBLICATIONS

PCT Written Opinion for Application No. PCT/US06/61215 mailed Jan. 9, 2008, 6 pp.

"Pollard Banknote and British Columbia Lottery Corporation Launch First-Ever Playbook™". Pollard Banknote Limited—News Release, Apr. 3, 2006. www.pollardbanknote.com/_pressreleases/2006_04_03.html. Download date Feb. 9, 2007. 2 pgs.

"The Pollard Playbook™". PollardBanknote Limited—Fusion Products. http://www.pollardbanknote.com/html/lamp_plybk.htm. Download date Feb. 9, 2007. 2 pgs.

"The Pollard Playbook™". PollardBanknote Limited—Laminated Products. http://www.pollardbanknote.com/_gamedemos/_laminate/lam_plbk.htm Download date Feb. 9, 2007. 3 pgs.

* cited by examiner

400

| | GAME IDENTIFIER: ABC-123 "ROOMMATES VOL. 1" 402 | | |
|---|---|---|---|
| | PRODUCT IDENTIFIER 404 | REDEMPTION VALUE 406 | REDEMPTION STATUS 408 |
| 400-1 | P-016837 | $30 | REDEEMED |
| 400-2 | P-056874 | $4 | REDEEMED |
| 400-3 | P-369542 | $0 | REDEEMED |
| 400-4 | P-876308 | $10,000 | NOT REDEEMED |
| | ⋮ | ⋮ | ⋮ |
| 400-N | P-N | $0 | NOT REDEEMED |

FIG. 4A

450

| | PRODUCT IDENTIFIER: P-557841 452 | | |
|---|---|---|---|
| | GAME IDENTIFIER: XYZ-987 "ROAD TRIP VOL. 4" 454 | | |
| | TOTAL REDEMPTION VALUE FOR P-557841: $45 456 | | |
| | SUB-PRODUCT IDENTIFIER 458 | SUB-PRODUCT REDEMPTION VALUE 460 | SUB-PRODUCT REDEMPTION STATUS 462 |
| 450-1 | P-557841-S1 | $3 | REDEEMED |
| 450-2 | P-557841-S2 | $8 | REDEEMED |
| 450-3 | P-557841-S3 | $2 | REDEEMED |
| 450-4 | P-557841-S4 | $0 | NOT REDEEMED |
| 450-5 | P-557841-S5 | $25 | REDEEMED |
| 450-6 | P-557841-S6 | $0 | NOT REDEEMED |
| | ⋮ | ⋮ | ⋮ |
| 450-N | P-557841-SN | $5 | NOT REDEEMED |

FIG. 4B

WIN ALL 9 RACE & WIN $1,000,000! A DAY AT THE RACES WIN ALL 9 RACE & WIN $1,000,000!

| WAGER | HORSE/ODDS | FIRST POLE | SECOND POLE | THIRD POLE | HOME STRETCH | FINISH |
|---|---|---|---|---|---|---|
| X | 1 10-1 | 1 | 1 | 1 | 1 | 1 5TH |
| X | 2 4-1 | 2 | 2 | 2 | 2 | 2 PLACE |
| X | 3 2-1 | 3 | 3 | 3 | 3 | 3 WIN |
| X | 4 8-1 | 4 | 4 | 4 | 4 | 4 6TH |
| BET $10 WIN | 5 3-1 | 5 | 5 | 5 | 5 | 5 SHOW |
| X | 6 6-1 | 6 | 6 | 6 | 6 | 6 7TH |
| BET $5 WIN | 7 8-1 | 7 | 7 | 7 | 7 | 7 8TH |
| X | 8 12-1 | 8 | 8 | 8 | 8 | 8 4TH |

YOUR BANKROLL FOR RACE #2 $24.00 TRIFECTA BET FOR RACE #1 3 WIN 2 PLACE 5 SHOW $500.00 YOUR WAGER FOR RACE #2 $15.00 YOUR WIN FOR RACE #2 $0.00 RACE BALANCE FOR RACE #2 $9.00 GO TO RACE 3

FIG. 8D

SYSTEMS, PRODUCTS AND PROCESSES FOR CONDUCTING INSTANT LOTTERY GAMES

This application claims the benefit of International Patent Application No. PCT/US2006/061215, filed Nov. 22, 2006, which is hereby incorporated by reference in its entirety.

This application claims the benefit of priority of U.S. Provisional Patent Application No. 60/739,259, filed Nov. 22, 2006, which is hereby incorporated by reference in its entirety.

This application claims the benefit of priority of U.S. Provisional Patent Application No. 60/739,111, filed Nov. 22, 2006, which is hereby incorporated by reference in its entirety.

NOTICE OF COPYRIGHT

The entirety of the disclosure of this patent application, including any drawings or exhibits filed herewith, contains material which is subject to copyright protection. The copyright owner has no objection to the facsimile reproduction by anyone of the patent document, patent disclosure, or patent drawings, as they appear in the Patent and Trademark Office patent files or records, but otherwise reserves all copyright rights whatsoever.

FIELD OF THE INVENTION

The present invention relates generally to lottery games and, more particularly, to systems, products and processes for producing and/or conducting instant (e.g., scratch-off) lottery games.

BRIEF DESCRIPTION OF THE DRAWINGS

FIG. 4A is a tabular representation of one embodiment of a product database;

FIG. 4B is a tabular representation of another embodiment of a product database;

FIGS. 8A-8D illustrate an embodiment of a lottery product;

DETAILED DESCRIPTION OF THE INVENTION

Figure 1:
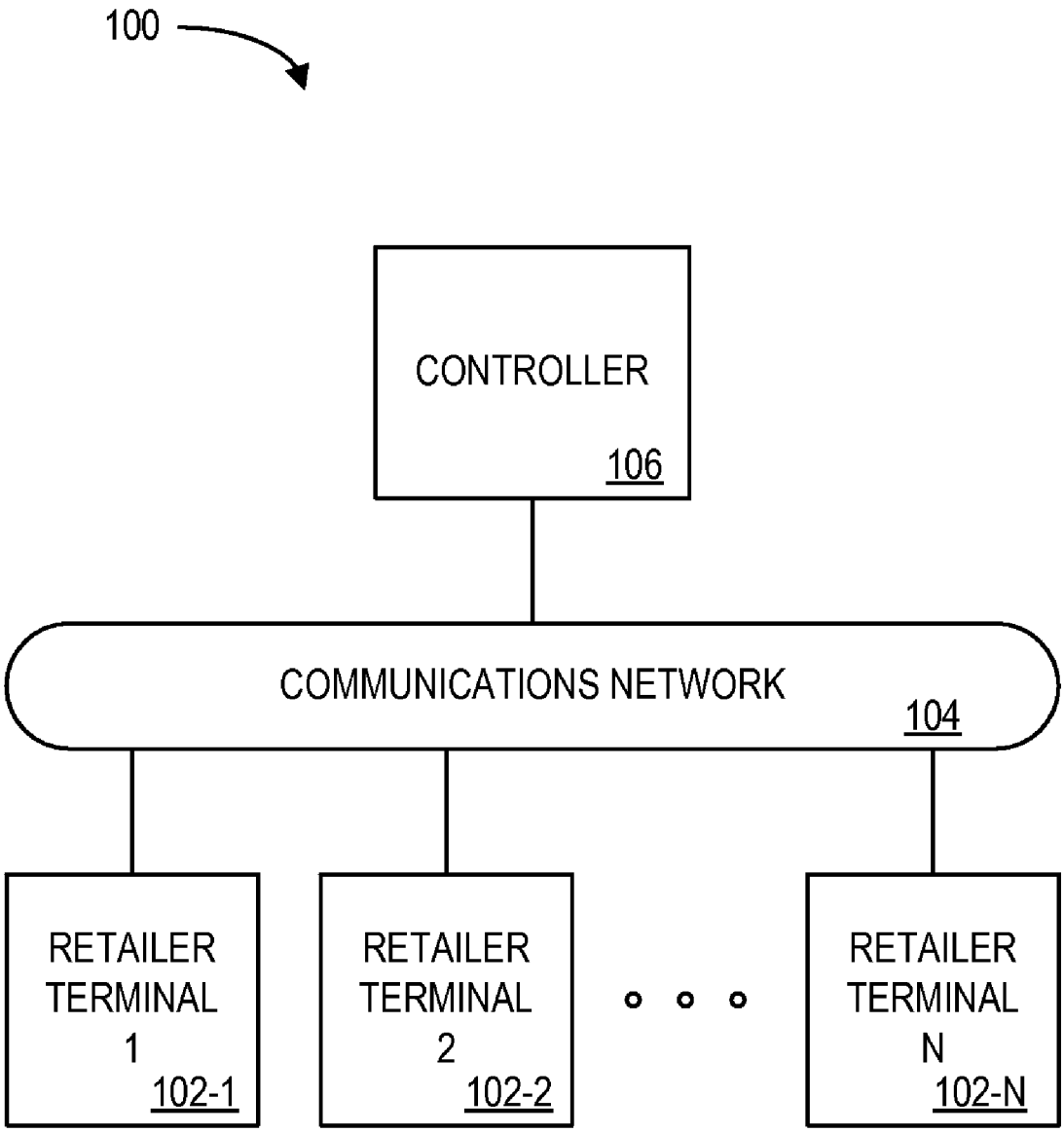
FIG. 1 illustrates a lottery system according to an embodiment of the invention that includes a plurality of lottery retailer terminals, a communications network, and a controller.

Advantages and features of the invention will become apparent upon reading the contents of this document, and the nature of the various aspects of the invention may be more clearly understood by reference to the following detailed description of exemplary embodiments of the invention, the appended claims and to the drawings attached hereto.

Lotteries are an important source of revenue for states or other entities seeking to augment their tax base in order to fund civic initiatives (e.g. infrastructure improvements and/or education initiatives). Accordingly, lottery operators seek new ways to appeal to the broadest range of potential lottery players.

In a typical instant lottery game, players purchase instant lottery tickets that may include one or more concealed play areas (e.g. "scratch-off" latex coated areas) that must be removed in order to reveal potential prize values and/or other game symbols. Certain combinations of symbols or values (such as alphanumeric indications of money amounts) correspond to prizes, thereby enabling players of instant lottery games to determine fairly quickly whether or not they are entitled to a payout or other award (e.g., goods or services).

Lottery operators are also seeking ways to get new players to play lottery games, and to retain lottery players. Some of the embodiments described in this disclosure provide advantageous ways to provide lottery products and processes that appeal to a wide range of potential lottery players. For instance, as noted above, play of a typical instant scratch-off lottery game does not usually take most players very long (e.g., the brief time it takes to remove all of the concealing latex on a scratch-off lottery ticket). Some types of current and potential players may find play of typical instant games uninteresting and/or too fast, and may find it appealing to be able to play a lottery game that includes elements of a story that may take some time to resolve, increasing the entertainment value of a lottery product to the player.

The present disclosure provides methods, systems, and apparatus that may be useful for producing and/or conducting lottery games. In some embodiments, As used in this disclosure, in accordance with some embodiments, a value (e.g., a redemption value) of a lottery product or a lottery game may refer to, for example and without limitation, a payout, prize, cash award, a score, a number of points, a product, a service, or a discount for which a lottery product or game may be redeemable (e.g., $2, a free admission to an amusement park, thirty points). In a preferred embodiment, the redemption value of a lottery product is zero or greater than zero in terms of monetary value (e.g., every book produced in accordance with a lottery game may be redeemed for at least $3). In accordance with some embodiments, the value of a lottery game may be negative (e.g., −20 points, a loss of $2), zero, or positive (e.g., $5). An outcome of an instant game may be used to refer to any indicia revealed by playing the game (e.g., three symbols revealed by scratching off a concealing layer of latex on a scratch-off lottery ticket) and/or may be used to refer to a value (e.g., a cash award) of the instant game.

As used in this disclosure, referring to a product, outcome, value, or game as redeemable or redeemed does not imply that the corresponding redemption value is not zero. For example, a losing scratch-off ticket may be considered redeemable in the sense that it may be presented for redemption or redeemed, even though the redemption value is zero.

As used in this disclosure, a product generally refers to an individual product available for retail sale (as discussed in this disclosure, such a product may comprise one or more components that may or may not be integral or physically connected). A lottery product may comprise two or more sub-products, and may comprise one or more game areas (e.g., a page or other portion of a product for use in playing an instant game, such as a portion that contains revealable covering elements). Game may be used in this disclosure to refer to an individual lottery product or to a sub-product (although not all sub-products are necessarily games), and/or to refer generally to a set of lottery products produced for conducting a particular game. Game or sub-game may also be used to refer to a game in a lottery product comprising a plurality of games (e.g., each page of a book product includes a game).

According to some embodiments of the present invention, a lottery product provides a plurality of outcomes. In one embodiment, the lottery product has a total redemption value that is based on the plurality of outcomes. In one embodiment, the lottery product comprises a plurality of instant lottery games, each instant lottery game has a respective outcome (e.g., at least one revealable element or game symbol; a prize; and/or a monetary value), and the redemption value of the lottery product equals, for example, a sum of the respective monetary values or a total value of the respective prizes. In some embodiments, the lottery product includes a representation of the redemption value of the lottery product (e.g., a removable concealing layer covers up the text "$5" that indicates the redemption value of the entire lottery product).

In accordance with one or more embodiments of the present invention, a lottery product is provided that includes a plurality of instant games, and the lottery product also includes a visual representation of the value of at least one of the instant games, such that an individual is able to discern or otherwise determine the value of at least one instant game without playing that game (e.g., without scratching off any of the removable covering on a lottery scratch ticket). In one embodiment, a representation of a value of a game is physically separate or is otherwise provided in addition to the game. For example, in some embodiments, the representation of the value of a game is on a different page, ticket, medium, or substrate, than that which includes the game. For instance, an instant scratch-off game is provided on a page of a booklet containing a plurality of such pages, and a representation of the value of that instant game is provided on a different page or on a cover of the book, or on a ticket that may be attached to or physically separate from the book. In one embodiment, the representation of a value of a game is initially concealed (e.g., by a removable latex covering). In another embodiment, the value of at least one game is not concealed.

In one example, a plurality of instant games are available for sale as a unit at a single price. For instance, two scratch-off games may be made available for purchase as a single product (e.g., bound together for sale as a booklet, or collected together in a bag or pouch for sale). The product also includes an additional ticket, page, or receipt, the additional portion of the lottery product including a description of the value of each of the scratch-off tickets. For instance, the product may include a summary page that includes revealable representations of the respective values of each of the scratch-off games, and may optionally include a revealable representation of the redemption value of the lottery product. Some types of purchasers of instant games may find it advantageous to be able to determine the value of one or more instant games quickly and/or without playing or redeeming the games themselves. For example, some types of purchasers may want to give an instant game to another person as a gift, but may want to know the value of the gift they are giving. Some types of players who do play one or more of the instant games may appreciate having a summary of the game play, or an alternative way to determine the result of each individual game without playing the games themselves (e.g., without scratching off the latex for a particular game to reveal the corresponding game elements). For example, a summary page for a book of lottery tickets may indicate the payouts for each of the lottery tickets.

In some embodiments, the redemption value of a lottery product may be redeemed conveniently, for example, by providing an identifier that identifies the lottery product (e.g., a barcode), without requiring an individual to provide each of (or any of) the plurality of outcomes. In an alternative embodiment in which a lottery product comprises a plurality of instant lottery games, each individual lottery game must be redeemed (e.g., using a conventional redemption process to redeem scratch-off lottery tickets at a lottery retailer) for an individual to receive the full value of the lottery product. According to another embodiment, at least one of the plurality of outcomes cannot be redeemed separately from the other outcomes, or without redeeming the entire lottery product.

According to one embodiment, at least one of the plurality of outcomes of a lottery product can be redeemed (e.g., for a cash award) on its own without redeeming the entire lottery product, or without redeeming every one of the plurality of outcomes. According to yet another embodiment, the lottery product includes at least one outcome that can be redeemed independently and at least one outcome that cannot be redeemed on its own.

According to some embodiments, an instant lottery game comprises a plurality of sub-payouts, with the sum of the sub-payouts equaling a total redemption value for the instant lottery game. One or more sub-payouts may or may not be redeemable independent of the redemption value.

In one embodiment, at least one sub-payout is redeemable by itself, without requiring redemption of the entire redemption value of the lottery product. In one embodiment, the sub-payout is less than the redemption value of the corresponding lottery product. In one embodiment, the sub-payout and/or a portion of the lottery product is transferable (e.g., by detaching or removing from the lottery product) to someone other than, for example, an initial purchaser of the lottery product. For example, a first type of game may comprise or include a plurality of sub-payouts totaling $5.00 (e.g. two sub-payouts of $2.00+one sub-payout of $1.00), wherein each of the sub-payouts may be redeemed or awarded separately. For example, multiple (e.g. separate) players or recipients may redeem each of the sub-payouts.

According to another embodiment, any sub-payouts associated with a total redemption value may not be redeemed independent of the total payout. For example, various sub-payouts may be allocated to non-redeemable "tickets" or pages in a booklet form in accordance with game rules. In accordance with such an embodiment, only the booklet as a whole and/or a dedicated or specified portion of the booklet (e.g., a certificate or a final page) may be redeemable for the entire redemption value associated therewith (i.e. the sum of all sub-payouts associated with the booklet).

According to some embodiments, one or more sub-payouts may comprise a negative payout. For example, a total redemption value may equal $7.00 and may be comprised of ten sub-payouts as follows:

| | |
|---|---|
| Sub-payout 1: | $0.00 |
| Sub-payout 2: | +$3.00 |
| Sub-payout 3: | −$1.00 |
| Sub-payout 4: | +$2.00 |
| Sub-payout 5: | $0.00 |
| Sub-payout 6: | $0.00 |
| Sub-payout 7: | +$3.00 |
| Sub-payout 8: | −$2.00 |
| Sub-payout 9: | +$1.00 |
| Sub-payout 10: | +$1.00 |
| Total Redemption Value: | +$7.00 |

In some embodiments, each sub-payout corresponds to a separate game area of a lottery product (e.g., an instant scratch-off ticket comprising one or more pages).

According to some embodiments, sub-payouts are determined and rendered onto physical media (e.g. paper stock) in accordance with various game rules. The physical media associated with the sub-payouts are then assembled into booklet form, the booklet being associated with a total redemption value. In one embodiment, each sub-payout is included on a separate page of the booklet. Depending on one or more game rules, as discussed above, sub-payouts may or may not be redeemed independent of the total redemption value associated with the booklet.

In one embodiment, the lottery product comprises a plurality, set, group, or collection of instant lottery games packaged for retail sale to consumers (e.g., players, or purchasers who may provide the lottery product or games of the lottery product to one or more recipients) as a single unit or product. The plurality of instant lottery games may be provided in any of various ways, some of which are described in this disclosure; other ways of providing the various lottery products of the present invention will be apparent to those skilled in the art in light of this disclosure.

In one example, at least two of the instant lottery games are physically separate from one another, and may be packaged, for example, in a sealed envelope, pouch, bag, box, or other type of packaging or common container suitable for holding such items. In another example, at least two of the instant lottery games are physically connected to one another, such as by binding, affixing, or fastening them together (e.g., by stapling or using adhesive). In another example, at least two of the instant lottery games are provided in the form of a book, booklet, or pamphlet, etc., in which the at least two games (or the page, ticket, or other media or substrate including the games) are bound along at least one edge.

In another example, some instant lottery games may be connected while at least one game is not connected to any other game.

In at least one embodiment, a game piece or other lottery product includes a plurality of game areas on a single piece of paper stock or other type of media (e.g., on a single ticket). The one ticket may comprise a single, flat piece, or may be folded or foldable to create multiple pages or portions. For example, a single piece of stock may be folded in half to create two interior pages and two exterior pages, and any one or more of the pages may include one or more game areas. In another example, a single piece of stock may be tri-folded. In some embodiments, each page includes a respective game or game area (e.g., including a removable concealing layer of latex). In some embodiments, the entire ticket may be presented for redemption. In one embodiment, as discussed above, the sub-payout corresponding to at least one game or game area may be redeemed independently or separately from the redemption value of the entire ticket. For example, a portion of a ticket corresponding to a winning game area (e.g., having an associated sub-payout of a positive value) may be detachable from the rest of the ticket (e.g., using perforations), and may be presented (e.g., by a purchaser or by a recipient of the detached portion) for redemption at a retailer, lottery agent, or via another conventional redemption process. For example, the detachable portion may include indicia (e.g., a barcode) for use in redeeming an associated sub-payout. Similarly, for embodiments comprising a plurality of different tickets or pages (e.g., assembled in a booklet), a particular ticket or page may be detachable from the rest of the collection of tickets (e.g., via a perforation) and removed for presentation in a redemption process.

Described below are non-limiting configurations of general-purpose components that may include hardware, software, middleware, and/or software processes and/or steps that may be employed to form a lottery system or portions thereof. The lottery system may include one or more databases stored in memory of one or more devices, and components configured to perform various functions in accordance with one or more embodiments described in this disclosure.

1. Lottery Communications Network

FIG. 1 illustrates a network environment 100 that includes a plurality of lottery retailer terminals 102-1 to 102-N, a communications network 104 and a controller 106. Generally, any or all of the retailer terminals 102-1 to 102-N may operate to: (i) receive information associated with one or more lottery products including such data as: (a) product and/or sub-product identifier(s), and (b) redemption values; (ii) transmit any or all of the received information to the controller 106 via the communications network 104; and (iii) output information including such data as: (d) information identifying lottery products and (e) information associated with one or more redemption values or benefits.

In general, each retailer terminal 102-1 to 102-N shown in FIG. 1 will correspond to (or be associated with) a particular lottery retailer. For example, retailer terminal 1 (102-1) of FIG. 1 may be associated with a first lottery retailer such as a convenience store, and retailer terminal 2 (102-2) of FIG. 1 may be associated with a second lottery retailer such as a supermarket. It should be understood that any number of lottery retailer terminals might be employed in a system 100, along with any number of corresponding controllers 106.

The controller 106 may operate to: (i) receive and store information associated with one or more lottery products including such data as product and/or sub-product identifier (s); (ii) determine at least one redemption value associated with a lottery product; and (iii) receive a redemption request associated with a lottery product.

In some embodiments, a retailer terminal 102-1 of FIG. 1 may be configured to perform some or all of the functions of the controller 106. Thus, in some embodiments, the controller 106 and the lottery retailer terminal 102-1 (or another given retailer terminal and controller pairing) may be considered as the same "device".

Generally, as explained above, the communications network of FIG. 1 may comprise or include one or more local and/or wide-area network(s), proprietary and/or public network(s) (e.g., the Internet) for facilitating two-way data communications between the retailer terminals 102-1 to 102-N and the controller 106. The lottery controller may communicate with lottery retailer terminals directly or indirectly, via a wired or wireless medium such as the Internet, via a local area network (LAN), via a wide area network (WAN), via an Ethernet, via a Token Ring, a telephone line, a cable line, a radio channel, an optical communications line, a satellite communications link, or via any appropriate communications means or combination of communications means. Any number and type of devices may be in communication with the lottery controller, and communication between the lottery retailer terminals and the lottery controller 106 may be direct or indirect, such as over the Internet through a Web site maintained by computer on a remote server, or over an online data network including commercial online service providers, bulletin board systems and the like. In some embodiments, the devices may communicate with one another and/or the computer over RF, cable TV, satellite links and the like. A variety of communications protocols may be part of any such communications system, including but not limited to: Ethernet (or IEEE 802.3), SAP, ATP, Bluetooth™, and TCP/IP.

Those skilled in the art will understand that devices in communication with each other need not be continually transmitting to each other. On the contrary, such devices need only transmit to each other as necessary, and may actually refrain from exchanging data most of the time. For example, a device in communication with another device via the Internet may not transmit data to the other device for days or weeks at a time. In some embodiments, a server computer may not be necessary and/or preferred. For example, in one or more embodiments, methods described herein may be practiced on a stand-alone device and/or a device in communication only with one or more other devices. In such an embodiment, any functions described as performed by a computer or data described as stored on the computer may instead be performed by or stored on one or more devices.

2. Lottery Retailer Terminal

Figure 2:
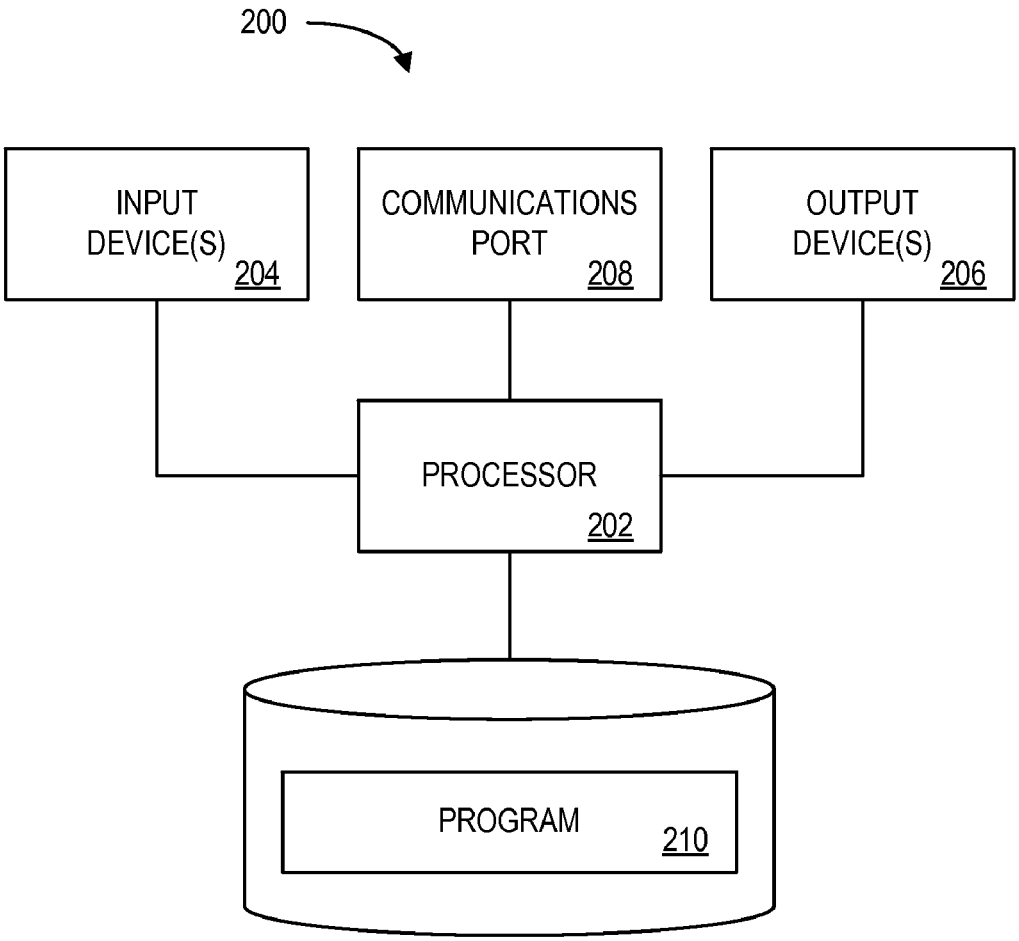
FIG. 2 is a block diagram of an embodiment of a lottery retailer terminal.

FIG. 2 is a block diagram 200 of some exemplary components of a lottery retailer terminal. The lottery retailer terminal 200 may include one or more processor(s) 202 such as the PENTIUM® processor, manufactured by INTEL Corporation, or other processors manufactured by other companies, such as the AMD Athlon® processor manufactured by the Advance Micro Devices company. Generally, the processor is operative to perform or process instructions, and in particular, to operate in accordance with the various methods described herein. For example, the processor 202 may be operable to allow the lottery retailer terminal 200 to transmit data to (and receive data from) the controller 106 of FIG. 1. More specifically, the processor 202 may enable the transmission of data defining or identifying a lottery product or sub-product.

Accordingly, the lottery retailer terminal 200 may further include one or more input device(s) 204. The input devices may include components such as an optical scanner and/or a barcode scanner, for reading and/or for deriving information associated with a lottery entry. For example, a lottery product may include registration marks, authenticity data, various codes, micro-printed indicia, one or more sense marks, and/or other lottery indicia that must be read, for example, to distinguish between one or more lottery products (which may all be contained on one lottery ticket or in one book product, for example). Examples of additional input devices include, but are not limited to, a keypad, a mouse, an image capturing device (e.g., an optical character recognition (OCR) device), a biometric reader, a portable storage device (e.g., a memory stick), and the like.

According to some embodiments, the lottery retailer terminal input device(s) 204 may comprise or include a clock. The clock may be employed to detect, derive and/or append time and/or date information for use by the controller 106 to: (i) create a data record corresponding to lottery products purchased at the lottery retailer terminal 200, and/or (ii) to determine redemption time and/or date information associated with lottery products.

The lottery retailer terminal 200 of FIG. 2 may further include one or more output device(s) 206. Such output device (s) 206 may include such components as a display for outputting information to a lottery player or to a terminal operator (e.g., win/loss information and/or payout amounts), one or more benefit output devices (e.g., a cash drawer, a currency dispenser), a printer for producing a physical record (e.g., paper slip, receipt, ticket, voucher, coupon, etc.) that defines a lottery product, audio/video output device(s), and the like.

The lottery retailer terminal 200 may also include one or more communications port(s) 208, such as a serial port, modem or the like. Generally, the communications port 208 may be operable to facilitate two-way data communications between (i) the lottery retailer terminal 200 and (ii) the controller 106 shown in FIG. 1. In accordance with some embodiments, the communications port 208 may operate to facilitate the transmission of information between the lottery retailer terminal 200 and a player device such as a personal digital assistant (PDA), cell phone and/or a dedicated (e.g., a proprietary) device.

The lottery retailer terminal 200 may further include a data storage device 210 such as a hard disk, optical or magnetic media, random access memory (RAM) and/or read-only memory (ROM), or the like memory device. Generally, the lottery retailer terminal data storage device 210 stores a software program, the software program enabling the processor 202 of the retailer terminal 200 to perform various functions including some or all of the various steps described herein. For example, as noted above with respect to FIG. 1, in accordance with some embodiments, the retailer terminal 200 may be configured to perform some or all of the functions of the controller (and vice versa) such that the controller 106 and the lottery retailer terminal 200 (or, referring to FIG. 1, a given lottery terminal and controller pairing) may be considered as the same "device". An example retailer terminal available in the marketplace is the EXTREMA® clerk-operated lottery terminal, distributed by Scientific Games Corporation of Alpharetta, Ga.

In some embodiments, a lottery sales device may be utilized in place of a lottery retailer terminal 200. Such a lottery sales device may be implemented as a system controller, a dedicated hardware circuit, an appropriately programmed general-purpose computer, or any other equivalent electronic, mechanical or electro-mechanical device. Thus, in various embodiments, a lottery sales device may comprise, for example, a Video Lottery Terminal that may include a touch sensitive screen for use by a player, a personal computer (e.g., which communicates with a remote lottery server), a telephone, or a portable handheld device (e.g., a device similar to a personal digital assistant (PDA) or other analog or digital communications device). The lottery sales device may comprise any or all of the devices of the aforementioned systems. In some embodiments, a user device such as a PDA, cell phone, and/or portable gaming unit (e.g. the Playstation™ Portable (PSP), distributed by Sony Corporation) may be used in place of, or in addition to, some or all of the device components.

3. Lottery Operator Controller

Figure 3:
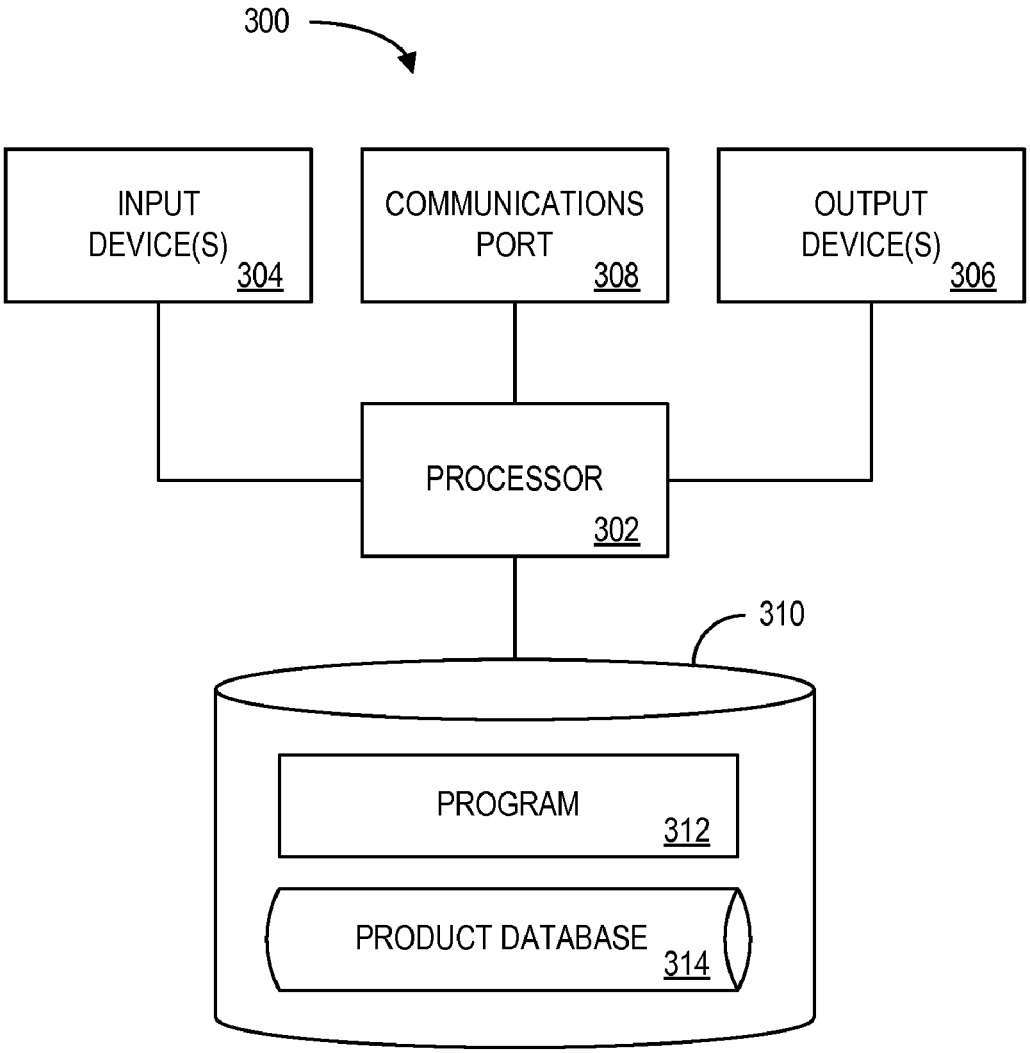
FIG. 3 is a block diagram illustrating an embodiment of a lottery operator controller.

FIG. 3 is a block diagram illustrating an embodiment of the components of a lottery operator controller 300. Similar to the lottery retailer terminal 200 of FIG. 2, the lottery operator controller 300 may include one or more processor(s) 302 such as the PENTIUM® processor manufactured by INTEL Corporation, or the AMD Athlon® processor manufactured by the Advance Micro Devices company. Such a processor 302 functions to process instructions, and in particular, to operate in accordance with various methods described herein. For example, the processor 302 may operate to allow the lottery operator controller 300 to transmit data to (and receive data from) the lottery retailer terminal 200 shown in FIG. 2. More specifically, the controller processor 302 may enable the transmission of data defining or identifying a lottery product, as well as information defining one or more payout(s) associated with that lottery product to a specific one of the lottery retailer terminals 102-1 to 102-N shown in the lottery network 100 of FIG. 1. Thus, the lottery operator controller may be implemented as a system controller, a dedicated hardware circuit, an appropriately programmed general-purpose computer, or any other equivalent electronic, mechanical or electro-mechanical device. In various embodiments, a lottery operator controller may comprise, for example, a personal computer (e.g., which communicates with a remote lottery sales terminal) or mainframe computer.

The lottery operator controller 300 may further include one or more input device(s) 304. Examples of such input devices include a keypad, a mouse, a touch-screen, a random number generator, a microphone, and other digital or analog input devices. According to some embodiments, the lottery operator controller input device(s) 304 may comprise or include a clock. As described above, the clock may be employed to derive time and/or date information for use by the lottery controller 300 to (i) generate a data record corresponding to lottery tickets or lottery entries purchased at the lottery retailer terminal 200, and/or (ii) determine redemption time and/or date information associated with lottery tickets and/or lottery entries.

The embodiment of the lottery operator controller 300 further includes one or more output device(s) 306. Example of output devices 306 include a monitor or other display for outputting information to a user of the lottery operator controller (e.g., for displaying information such as statistical or sales data, win and loss information and/or payout amounts), a printer for producing a physical record (e.g., a report, a paper slip, a voucher, a coupon, a ticket) of such data, and the like. In addition, the lottery operator controller 300 may include one or more communications ports 308, such as a serial port, modem or the like, operable to facilitate two-way data communications between (i) the operator controller 300 and (ii) one or more lottery retailer terminals 200, as described above with respect to FIGS. 1 and 2.

The lottery operator controller 300 may also include a data storage device 310 (e.g., a hard disk or hard drive, a media-based (removable) memory, or the like). In some embodiments, the lottery operator controller data storage device 310 stores at least one software program 312, which includes a program to enable the processor 302 to perform some or all of the various steps and functions of at least one implementation of the methods described in detail herein. In addition, the lottery operator controller data storage device 310 may operate to store a product database 314 (described below with respect to the exemplary databases 400 and 450 shown in FIGS. 4A and 4B, respectively).

In some embodiments, the lottery operator controller may include a lottery product server device that is located at a lottery product production facility, and may also function to manage the production process. The lottery operator controller may also function to develop a lottery game matrix (e.g., determining payouts, sub-payouts, sub-payout distributions within each product, win frequencies and the like) and to match static lottery content with secure paytable (or payout distribution) data. In some embodiments, a printer device for use in such lottery systems may utilize the game matrix information from the lottery server and may apply it to the secure paytable data.

4. Other Devices

In some embodiments, a kiosk (not shown) may be configured to execute or assist in the execution of various lottery game processes. In an implementation, a kiosk may comprise a processor and a storage device or memory as described above. A kiosk may also comprise various input devices (e.g., a keyboard, a mouse, buttons, an optical scanner for reading barcodes or other indicia, a CCD camera, and the like), output devices (e.g., a display screen, audio speakers), benefit output devices (e.g., a coin tray, a currency dispenser), communications ports, and the like. A kiosk may be configured to communicate with a lottery controller or lottery server. In some embodiments, kiosks may execute or assist in the execution of various lottery functions, as described herein.

In some embodiments, players may use one or more computing devices to obtain more information about lottery games, and/or the specific lottery game that the player is playing. For example, a player may utilize a personal computer to access a website that contains lottery game hints, lottery game instructions, winning lottery product payout information that includes total payout and sub-payout information (if applicable), and the like.

5. Product Database

It should be understood that the various database examples described herein include illustrative accompanying data as shown in the drawings. Consequently, the data appearing in the databases is exemplary in nature, and such data entries are not limiting with regard to functionality or to the types of data that may be stored therein.

FIG. 4A is a tabular representation of one embodiment 400 of a product database 314 that may be utilized by a lottery operator controller. Product database 400 stores data associated with one or more lottery products. In general, the product database 400 stores information that may be used by the lottery operator controller to determine the redemption value of a lottery product. The database 400 includes a game identifier field 402 that identifies the game the lottery products with which the lottery products are associated. A product identifier field 404 is also included for storing information identifying a particular lottery product (e.g., a particular printed copy of "ROOMMATES Vol. 1" made available for sale). Redemption value field 406 includes an indication of the redemption value for that corresponding particular lottery product. Redemption status field 408 includes an indication of whether the value of the lottery product has been redeemed (e.g., whether a player has submitted a redemption request to request the redemption value; whether a player has actually been provided the value corresponding to the lottery product). In one embodiment, redemption status field 408 may store information representing whether or not an available payout associated with the given product has been issued, claimed or awarded.

For example, as shown in rows 400-1 and 400-2, for lottery products P-016837 and P-056874 the redemption values are $30 and $4, respectively, which indicates that these two products are winning lottery products, and they have been redeemed. However, for row 400-3, product P-369542 is associated with a redemption value of $0. Lottery products with zero redemption value may still be redeemed to the extent that they may be processed to determine the redemption value; of course, no value is conferred to the player if the value is $0. As shown in row 400-4, product P-876308 has an associated redemption value of $10,000.00 and has not yet been redeemed. As shown in row 400-N, product P-N has an associated redemption value of $0 but also has not yet been redeemed (e.g., no redemption request has yet been received).

FIG. 4B is a tabular representation of one embodiment 450 of the product database 314 that may be utilized by a lottery operator controller. Product database 450 stores data associated with one or more lottery sub-products of a particular lottery product. In general, the product database 450 stores information that may be used by the lottery operator controller to determine the redemption value of a lottery product and/or one or more sub-products of which the lottery product is comprised. The database 450 includes a product identifier field 452 that identifies the particular product (e.g., "P-557841") with which the lottery sub-products are associated. A game identifier field 454 is also included for storing information identifying a particular game (e.g., "ROAD TRIP VOL. 4") corresponding to the particular lottery product. Total redemption value field 456 includes an indication of the redemption value for the particular lottery product. The database 450 further includes one or more records corresponding to respective sub-products of the lottery product. Database 450 includes a sub-product identifier field 458 that identifies a particular sub-product of the lottery sub-product. Sub-product redemption value field 460 includes an indication of the redemption value for the particular lottery sub-product, and sub-product redemption status field 462 includes an indication of whether the value of the lottery sub-product has been redeemed. In one embodiment, redemption status field 458 may store information representing whether or not an available payout associated with the given product has been issued, claimed or awarded.

For example, as shown in rows 450-1, 450-2, 450-3, and 450-5, for lottery sub-products P-557841-S1, P-557841-S2, P-557841-S3, and P-557841-S5, the redemption values are $3, $8, $2, and $25, and all of those corresponding sub-products have been redeemed. Sub-products that have not been redeemed are indicated in example rows 450-4, 450-6, and 450-N.

The lottery operator controller 106 shown in FIG. 1 (and the lottery operator controller 300 referred to in FIG. 3) in conjunction with the various data structures described herein may perform one or more various redemption processes.

In one embodiment, a redemption request to redeem a lottery product is received, and then a determination is made as to whether the lottery product is a winning product (e.g., whether the lottery product is associated with a positive monetary value or other redemption value). For example, a player presents his lottery ticket to a clerk who scans a barcode on last page of a lottery book product into a retail lottery terminal, and then a lottery server provides information about that lottery book product which is displayed to the clerk. The lottery product identifying information may be transmitted from the lottery retailer terminal to the lottery operator controller, which then compares the product identifier and/or other indicia to data that may be stored in one or more databases. For example, the controller 106 shown in FIG. 1 may receive a redemption request by way of the communications network 104 from any of the retailer terminal(s) 102-1 to 102-N and then verify that the lottery products corresponds to a winning product in a product database for a lottery game (e.g., that has not expired). In some embodiments, as described in this disclosure, a lottery sub-product may be redeemed (e.g., for a corresponding sub-payout) without redeeming any or all of the other sub-products for the corresponding lottery product. For example, a sub-product identifier may be received and processed in a manner similar to that described herein with respect to redemption of a lottery product. In embodiments in which only an entire product, or at least one other sub-product must be redeemed with a first sub-product, the lottery controller 106 may transmit a signal to a lottery retailer terminal 102 indicating that the first sub-product alone is not sufficient to provide any payout for the lottery product.

In accordance with an embodiment comprising multiple instant games, because each lottery sub-product or sub-game outcome (and the outcome of the lottery product as a whole) is predetermined, the payout value of a particular lottery product or sub-product may be retrieved from a database (e.g., see the lottery product databases of FIG. 4A and FIG. 4B). In some embodiments, the payout value of a particular lottery product may be calculated and/or determined in direct response to the request (e.g., by calculating the sum of the outcomes of a plurality of sub-games).

If a lottery product (or sub-product) is not a winning product then no payout is made to the player. However, if the lottery product is a winning product, then the corresponding payout is authorized. In some embodiments, the lottery controller authorizes the issuance of a lottery payout by transmitting information associated with the determined payout to the appropriate lottery retailer terminal. Such information may then be used to instruct a lottery terminal operator (such as a retail store clerk or cashier) to confer the payout to the player (e.g., a display associated with the terminal may output and/or display an indication to the operator to pay the player an amount of cash).

In accordance with some embodiments, after authorizing the issuance of a payout or other redemption value (e.g., by transmitting information to the appropriate lottery terminal), the controller then updates the appropriate field(s) in the product database 400 to reflect that the lottery product and/or lottery sub-product(s) have been redeemed.

6. Products and Production Processes

Figure 5:
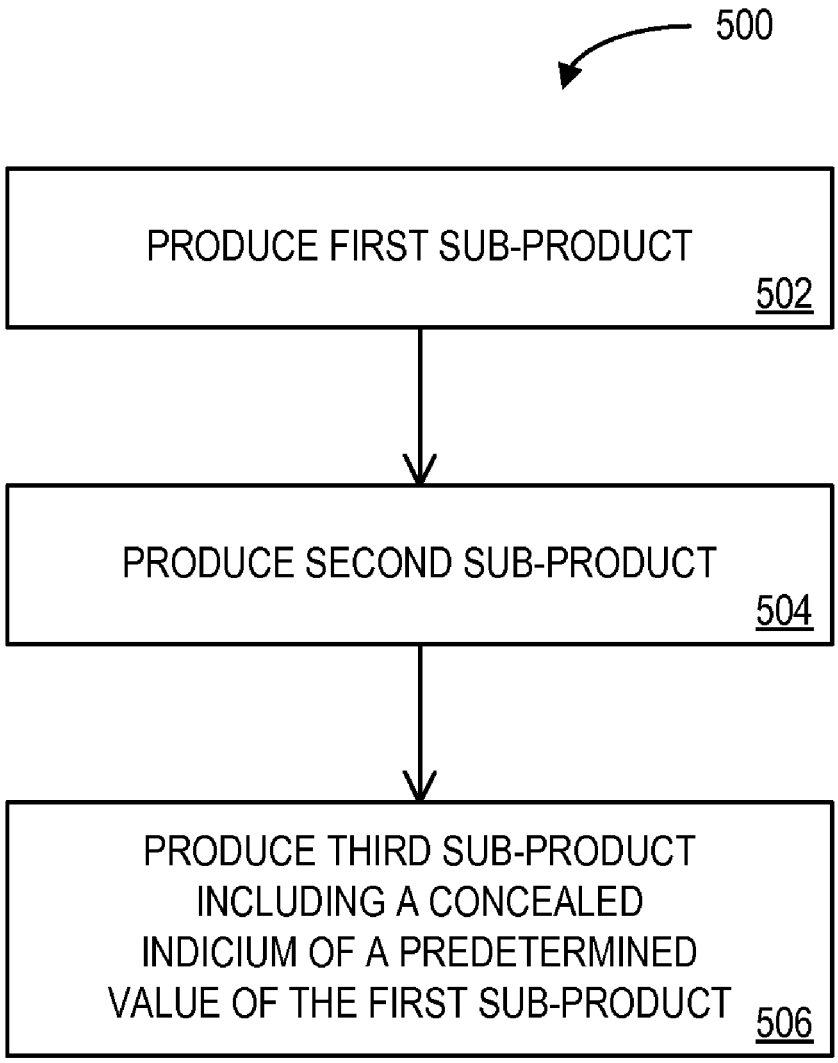
FIG. 5 is a flowchart illustrating one embodiment of a process for producing lottery sub-products.

FIG. 5 is a flowchart of a production process 500 according to one embodiment described in this disclosure. Process 500 may be performed, for example, by or on behalf of a lottery controller. In one example, a lottery controller (e.g., a state lottery authority) contracts with a manufacturer to produce lottery products for one or more lottery games, as will be readily understood by those skilled in the art.

A first sub-product is produced in step 502, and a second sub-product is produced in step 504. For example, as discussed in this disclosure, each sub-product may comprise one or more instant scratch-off games including removable latex or other covering, that when removed reveals game elements previously concealed by the covering. The game elements may be used by the player to discern whether the particular sub-product is a winner, in a manner readily understood by those skilled in the art (e.g., whether the player has revealed two matching symbols in a set of six revealed symbols). Of course, as will also be understood, many types of instant games may be redeemable without being played (e.g., without the player scratching them), by providing a product identifier (e.g., a barcode) to a lottery retailer for verification.

A third sub-product is produced in step 506. The third sub-product includes a concealed indicium of a predetermined value of the first sub-product. For example, the third sub-product is distinct from the first sub-product, but includes an indication of the value of that first sub-product. In one embodiment, the third sub-product comprises a summary page of a book of instant games, and the summary page includes an indication, concealed under a removable latex covering, of the value of at least one particular page of the book (e.g., the third page of a 10-page book).

Other embodiments of lottery products are discussed in this disclosure, and various processes for producing such lottery products will be readily understood by those skilled in the art in light of the present disclosure.

Some embodiments of the present invention provide for a game product and method for producing the game product, and systems and processes for redeeming such game products. In one embodiment, the game product comprises a first instant game that is individually redeemable for a first predetermined value of the first instant game. The first instant game includes one or more indicia that are concealed, that are revealable, and that indicate the first predetermined value of the first instant game. The game product also includes a second instant game packaged with the first instant game, in which the second instant game is individually redeemable for a second predetermined value of the second instant game. The second instant game includes one or more indicia that are concealed, that are revealable, and that indicate the second predetermined value of the second instant game. The game product also includes a game area packaged with the first instant game, in which the game area is distinct from the first instant game and the second instant game. The game area includes (1) a first identifier that identifies the first instant game, (2) one or more first indicia that are concealed, that are revealable, and that indicate the first predetermined value of the first instant game, and (3) one or more second indicia that are concealed, that are revealable, and that indicate the second predetermined value of the second instant game.

According to one or more embodiments, a lottery product or game includes a plurality of games that are connected in theme or content.

In some embodiments, a lottery product provides a story (or a portion, issue, or episode of a multi-part story). In some embodiments, a story provided in the lottery product may include or consist entirely of illustrations, graphic designs, a graphic novel, a comic strip, a comic book, etc. In some embodiments, each of the plurality of games of the lottery product includes a respective portion of the story. In one embodiment, each page and/or panel of a graphic novel or comic book comprises a respective instant game.

In one embodiment, dialog, text, scenes, props, figures, characters, sounds, or other types of elements depicted in an illustrated story may be used in play of an instant game. For example, the occurrence of a predetermined word (or words) in the dialog of a page or panel of a graphic novel may correspond to a respective payout for a game associated with that page or panel. In some embodiments, some or all of the dialog or other elements used for play of an instant game in a story product may be concealed initially. For example, a player may be able to scratch off a latex layer covering one or more of the dialog balloons in a graphic novel to reveal dialog used in telling the story provided by the lottery product.

According to one or more embodiments of the present invention, a story product includes a plurality of pages for providing a story. At least one page of the story includes at least one instant game, and the story product further includes a table or other representation that identifies at least one element or elements, in which the occurrence of the identified element(s) in the story would correspond to a prize, monetary award, or other redeemable value for the story product (or, in some embodiments, for the particular page or other portion of the story in which the element occurs).

In accordance with some embodiments of the present invention, multiple outcome values may be provided in one story product. For example, a plurality of outcome values may be interspersed throughout an entire issue of a comic book (e.g., in all or in a plurality of the panels). In another example, each chapter or page of a story corresponds to an outcome value.

According to some embodiments of the present invention, a book or other type of story product is provided, in which the book includes an instant game, such as a promotional or lottery scratch-off game.

In one or more embodiments of the present invention, a graphic novel or other type of product including an illustrated story is provided, in which the comic book includes a paytable, a first page including a first removable covering and a second page including a second removable covering.

In accordance with one embodiment, a particular story (or aspect of a story) may be associated with multiple arrangements for the provision of various outcome values or various combinations of values to be provided via the story. For example, a specific issue of a comic book may be associated with multiple payout tables (e.g. each character may be associated with one or more pay tables), one or more of which may be selected (e.g. randomly) by a publisher of the book, a lottery agent, a lottery authority, and/or a player at the outset of play or at another time. For instance, a player may be able to select a payout table corresponding to his favorite character.

According to some embodiments, a player may earn an outcome value for each time a character of a story speaks a particular line, phrase or type of phrase. Additionally or alternatively, a player may earn an outcome value each time a particular prop or type of prop is shown or used, etc.

According to some embodiments, in a first edition of a story product, a player may be provided with a first value based on a character speaking a particular word or phrase, but in a second edition of the story product (e.g., one that includes the same story but uses a different set of winning words or phrases to determine values) a player (the same or a different player) may be provided with a second value that is different from the first value upon the same character speaking the same line.

According to some embodiments, a plurality of editions of an illustrated story (e.g., a comic strip, graphic novel, or comic book) may be provided with identical graphics or pictures, but the text or dialogue may differ between at least two editions of the story product.

According to one embodiment, the occurrence of a particular phrase, type of phrase, prop, type of prop and/or another event anywhere in the story may correspond to a bonus outcome. For example, each page of a booklet may have its own respective winning elements associated with it, but the player may also earn a prize upon the occurrence of a particular (e.g. hallmark) phrase occurring anywhere within the provided story.

According to another embodiment, each character (or groups of similar characters) in a given instance of a story (e.g., a particular issue of a comic book) may be associated with multiple sets of winning indicia.

Some embodiments of the present invention provide for a lottery product comprising a plurality of sub-products, a method for producing the lottery product, and systems and processes for redeeming such a lottery product. One example method for producing a lottery product comprises producing a first sub-product including at least one concealed first indicium that is revealable, the at least one first indicium including at least one first game element and an indication of a first predetermined value of the first sub-product. The first predetermined value may be less than zero (e.g., a negative sub-payout).

The method also includes producing a second sub-product including at least one concealed second indicium that is revealable, the at least one second indicium including at least one second game element and an indication of a second predetermined value of the second sub-product. The method further includes producing a third sub-product including (1) a first identifier that identifies the first sub-product, (2) a third concealed indicium that is revealable and that indicates (e.g., visually or in a manner that can be discerned by a player) the first predetermined value of the first instant game, and (3) a fourth concealed indicium that is revealable and that indicates the second predetermined value of the second instant game. The first, second, and third sub-products are assembled to form a lottery product (e.g., a book, a graphic novel). Optionally, the third sub-product includes an indication of a total redemption value (e.g., a sum of the first redemption value and the second redemption value) of the lottery product (e.g., on a last page or cover of a book of instant games). In one embodiment, the third sub-product is printed on one page and the first sub-product is printed on a different page. In one embodiment, a described in this disclosure, a sub-product includes a machine-readable identifier that is associated with a first predetermined value for the sub-product, thereby allowing the first predetermined value to be redeemed separate from the second predetermined value (e.g., by presenting a barcode to a lottery retailer).

In accordance with at least one embodiment of the present invention, a lottery product comprises a plurality of instant games, each instant game having a respective monetary value; and a concealed, revealable location that includes a visual representation of a total value, in which the total value is a sum of at least two of the respective monetary values.

Some embodiments of the present invention provide for a lottery product providing a story, a method for producing the lottery product, and systems and processes for redeeming such a lottery product. One example of a method for producing such a lottery product comprises printing a first page that embodies a first instant game, the first page including a first removable covering concealing a first element of a story, and the first page being associated with a first predetermined sub-payout. The method also includes printing a second page that embodies a second instant game, the second page including a second removable covering concealing a second element of the story, and the second page being associated with a second predetermined sub-payout. The method further provides for printing a table (e.g., printing a secure paytable on a ticket or other substrate) that (1) identifies a third element of the story (e.g., a winning word or phrase of dialog, character, prop, and/or event) and indicates a first potential prize for the first instant game if the third element matches the first element and (2) identifies a fourth element of the story and indicates a second potential prize for the second instant game if the fourth element matches the second element. The method further includes assembling the first page, the second page, and the table into a lottery product (e.g., printing the first page, the second page, and a secure paytable as a booklet; combining for sale an on-line ticket including the table with a book containing the first page and the second page). In various embodiments, the story may comprise historical information, educational information, safety information, tourism information, play of a sports game, an adventure story, a plurality of races, and/or a journey. Different lottery products may have different tables (e.g., different winning symbols or other game elements that may be compared with revealable elements on pages of a book).

Some embodiments of the present invention provide for a story product, a method for producing the story product, and systems and processes for redeeming a story product. In one embodiment, a story product comprises a plurality of instant scratch-off games assembled as a book, each instant scratch-off game comprising a respective covering element that conceals respective revealable dialog of a story, and a paytable for the book, the paytable indicating respective winning dialog for each of the plurality of instant scratch-off games. As discussed in this disclosure, a paytable may be embodied in the book, may be physically separate from the book (e.g., may be an on-line ticket printed at the time of purchase of the story product), and may be detachably removable from at least one of the instant games.

Some embodiments of the present invention provide for a game product comprising a plurality of sub-games, a method for producing the game product, and systems and processes for redeeming a game product. One embodiment of a method for producing a game product includes printing a first sub-game, the first sub-game comprising (1) a concealed first game element that is revealable, (2) an indication of a first predetermined value of the first sub-game, and (3) an indication of a first predetermined running value of the game product. The method also includes printing a second sub-game, the second sub-game comprising (1) a concealed second game element that is revealable, (2) an indication of a second predetermined value of the second sub-game, and (3) an indication of a second predetermined running value of the game product. The method further includes assembling the first and second sub-games to form the game product.

Various examples of game and lottery products that may be produced in accordance with various aspects of the present invention are described below.

Some embodiments of the present invention provide for a storybook or other story product comprising a plurality of instant lottery games. For example, a plurality of instant games that collectively convey a story or a part of a multi-part story may be created and bound together for sale in booklet form and offered at a predetermined price. As an example, fifteen such related games may be created and bound into booklet form and offered for sale for $20. For example, a story may comprise play of a baseball game, a drama or comedy, an action/adventure story, a series of races (e.g., horse races), a trip (e.g., a road trip to various locations), etc.

According to some embodiments, a storybook comprises a plurality of scratch-off games, in which the area for each game includes one or more concealing elements that when removed reveal dialog elements of a story, and the storybook also comprises a paytable for that storybook. The paytable indicates the winning indicia for each instant game included in the storybook (e.g., winning words whose occurrence result in a prize indicated in the paytable for that page or game of the storybook).

One example of a storybook is illustrated with respect to FIGS. 6A-6J and 7A-7J. Generally, FIGS. 6A-6J depict an example storybook in which none of the concealed locations has been revealed (e.g., scratched or played), and FIGS. 7A-7J depict the same storybook as if all of the revealable locations of the storybook were revealed.

Figure 6A:
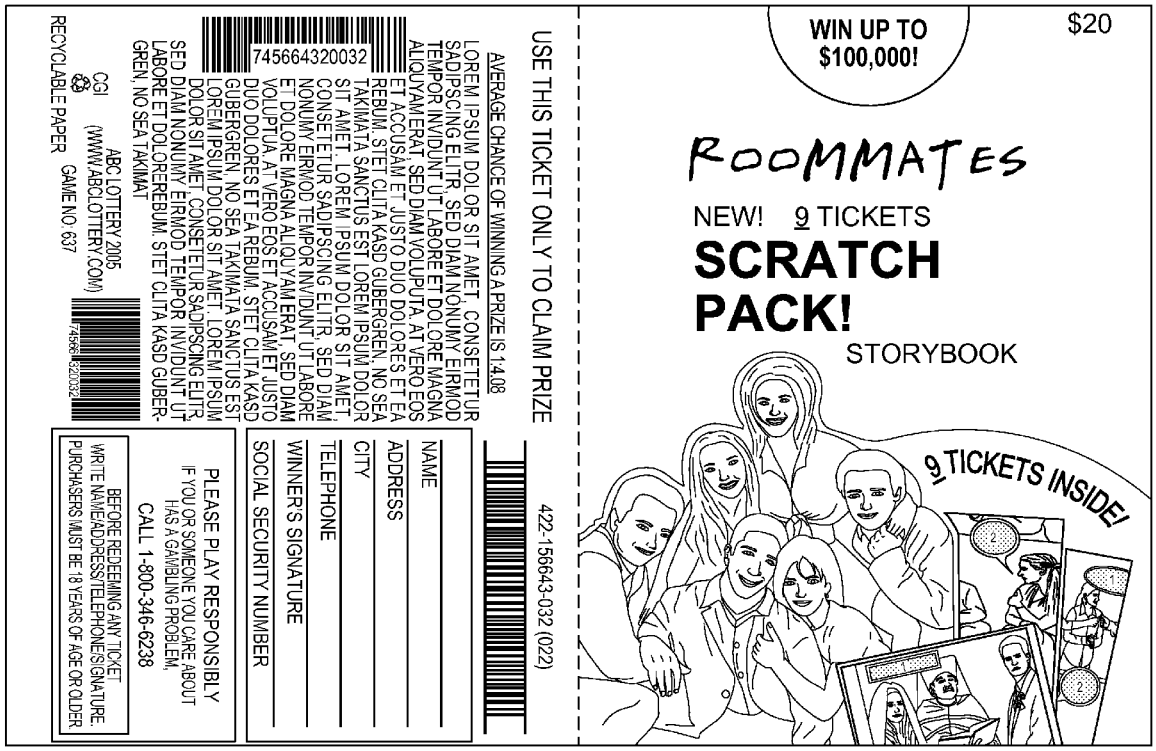
FIGS. 6A-6J illustrate an embodiment of a lottery product.
Figure 6B:
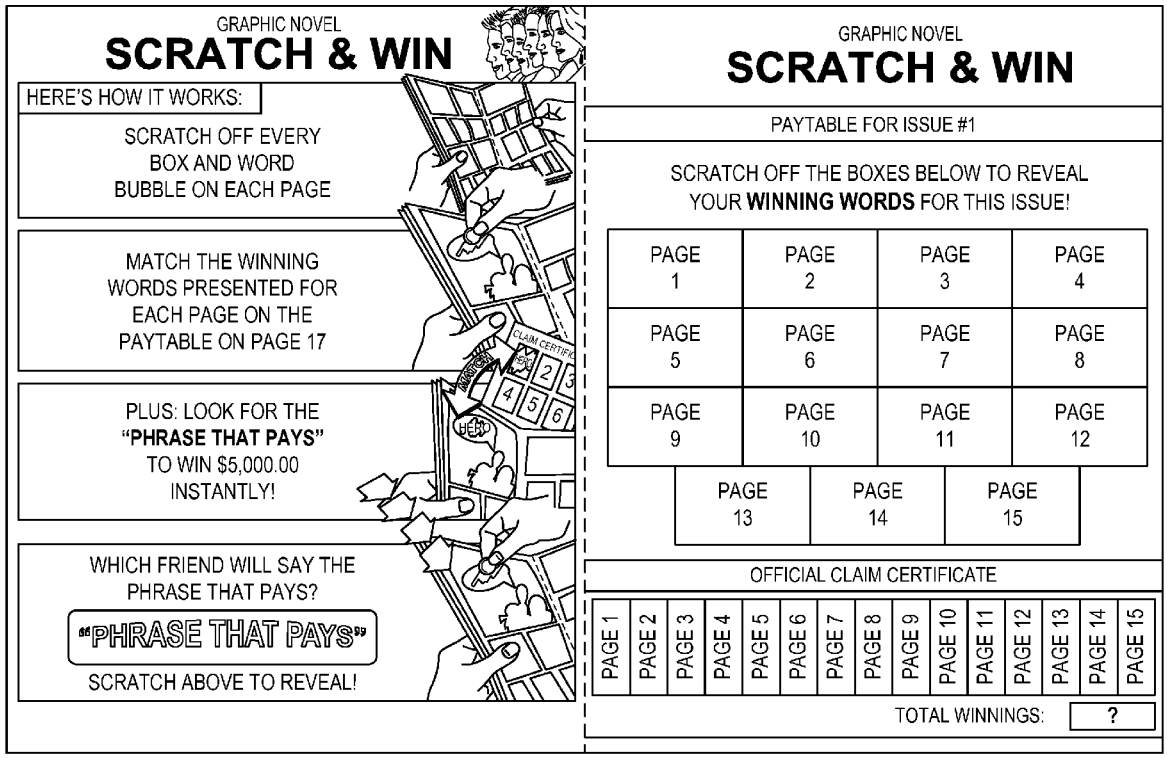

As will be readily understood by those skilled in the art, each figure in FIGS. 6A-6J and FIGS. 7A-7J represents an image that may be printed on a side of a piece of paper stock or other type of media, in which each piece of stock is then folded and bound with other pieces to form the booklet. For instance, FIG. 6A depicts an image of the back and front covers of the booklet (the left half and right half of the image, respectively), and FIG. 6B depicts an image of the first inside page and the last inside page of the booklet (the left half and right half of the image, respectively). As depicted in the illustrations, the image of FIG. 6A could be printed, for example, on one side of a single piece of paper stock, and the image of FIG. 6B could be printed on the other side of that piece, such that the piece could be folded in half (as indicated by the dashed line in the figures) to provide the desired configuration of the four pages. Some systems, processes, and apparatus that may be useful for creating bound printed products are described in U.S. Pat. No. 6,363,851, which is incorporated by reference in this disclosure.

As an illustrative example, FIG. 6A shows the back and front of the outside cover of a storybook that includes a story involving characters of a television series "Roommates." As shown the front cover includes an indication of the predetermined price of the storybook ($20). As shown, the back cover includes a ticket that may be redeemed to claim a prize for the storybook. The ticket includes a bar code that may be used in a conventional redemption process, and could further include rules and regulations for the game, and space for a player to write information (e.g., as might be necessary when redeeming or mailing in a ticket). Of course, indicia other than bar codes may be used to identify a ticket or storybook for purposes of sale and/or redemption.

Figure 7A:
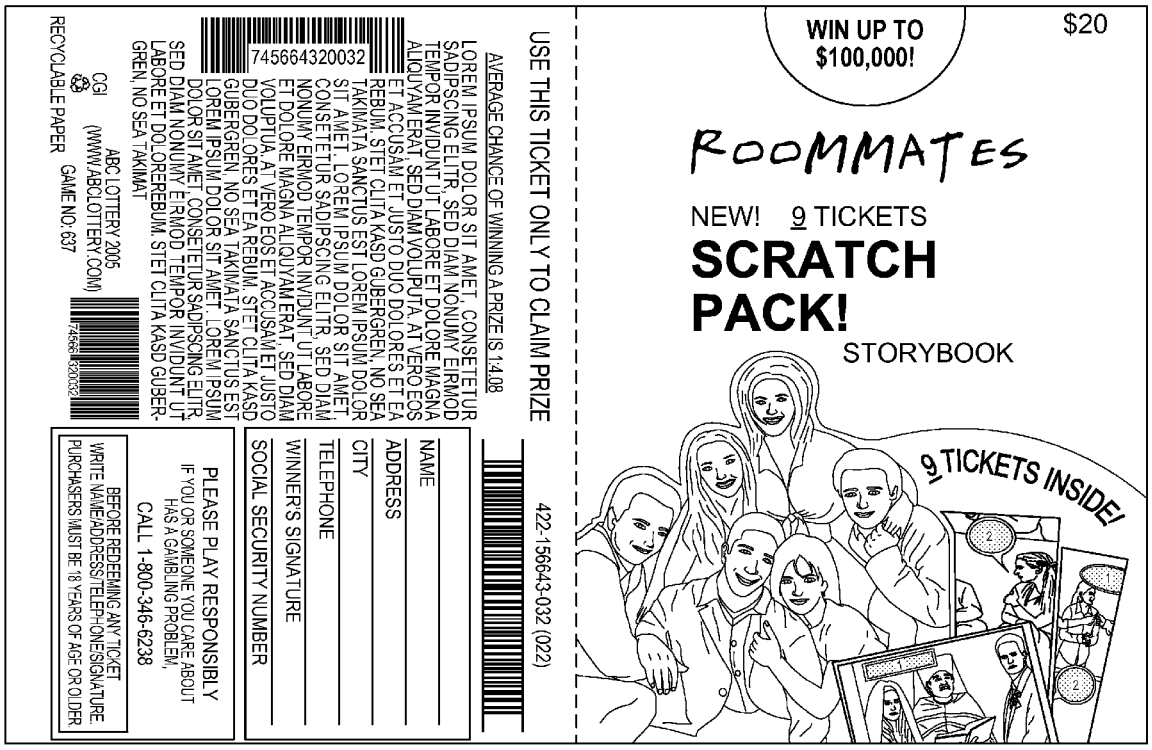
FIGS. 7A-7J illustrate an embodiment of a lottery product.
Figure 7B:
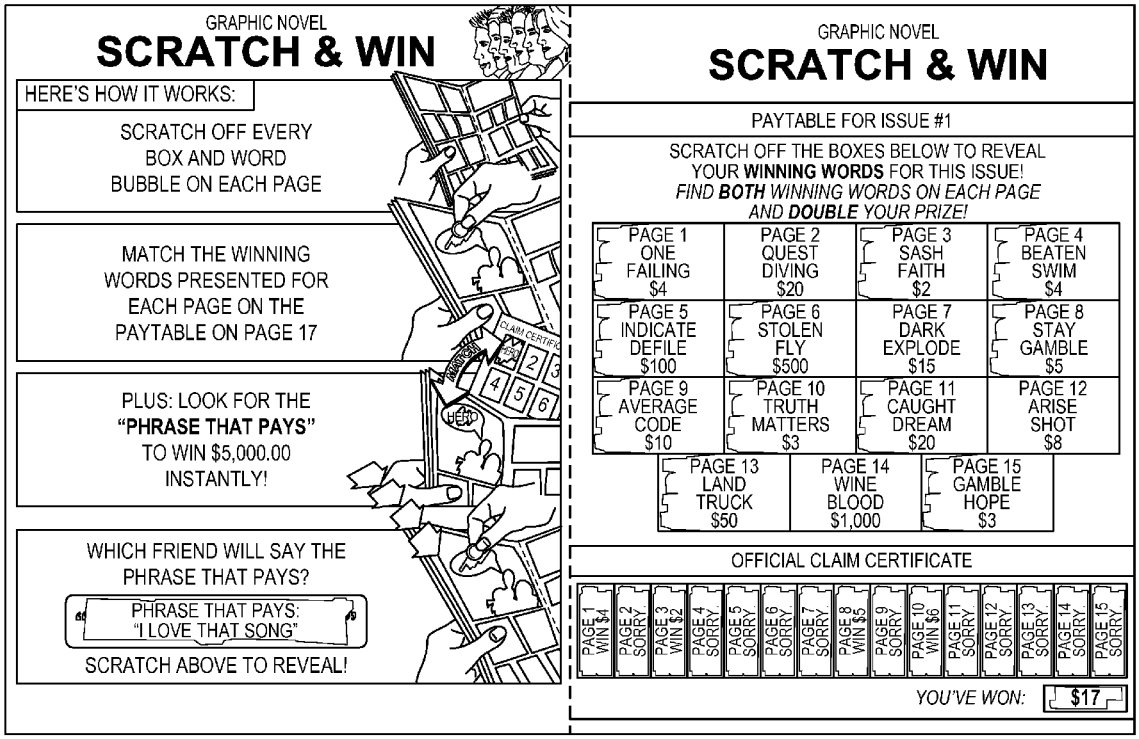

FIGS. 6B and 7B show the first (on the lefthand) and last (on the righthand) inside pages of the sample storybook. The first inside page includes graphics explaining and demonstrating play of the storybook. That page also refers to a "phrase that pays," which, if it occurs anywhere in the storybook, will result in a bonus prize of $5000. In the example, an occurrence of "I LOVE THAT SONG" will win the indicated prize (see FIG. 7B).

The last inside page (righthand side of FIGS. 6B and 7B) includes a sample paytable for this issue of the storybook. The sample paytable indicates that every one of the indicated pages (pages 1-15) includes a respective instant game. Each page has an associated set of two words that are the winning indicia for that page/sub-game. Accordingly, if one or more of those words appears on the corresponding page (e.g., is revealed by scratching off the dialog balloons on that page), the player wins the prize indicated for that page.

In accordance with some embodiments of the present invention, the last inside page further includes a respective representation of the actual value for each individual game/page in the storybook (as distinguished from the potential value/prize indicated in the prize table). In the depicted example, the plurality of areas are initially covered by a removable concealing layer, but this representation does not necessarily have to be concealed. In the depicted example, the area corresponding to page 1 indicates that the game on page 1 is a winner worth $4. Accordingly, if a player does not want to he does not have to scratch off either the paytable (on the last inside page) or the dialog boxes (on page 1) to determine whether page 1 includes a winner. The player can simply scratch off the "page 1" box in the lower game area on the last inside page to reveal the value of the game corresponding to page 1. Accordingly, a player could determine the redemption value of the storybook without actually playing any of the games (e.g., without actually scratching off any of the dialog boxes on the illustrated pages).

In accordance with various embodiments of the present invention, the last inside page further includes a representation of the actual or total redemption value of the storybook (e.g., the monetary award that would be provided to a player upon redeeming the entire storybook). Accordingly, a player could determine the redemption value of the storybook without actually playing any of the games or first determining the value of any individual game or page.

Figure 6C:
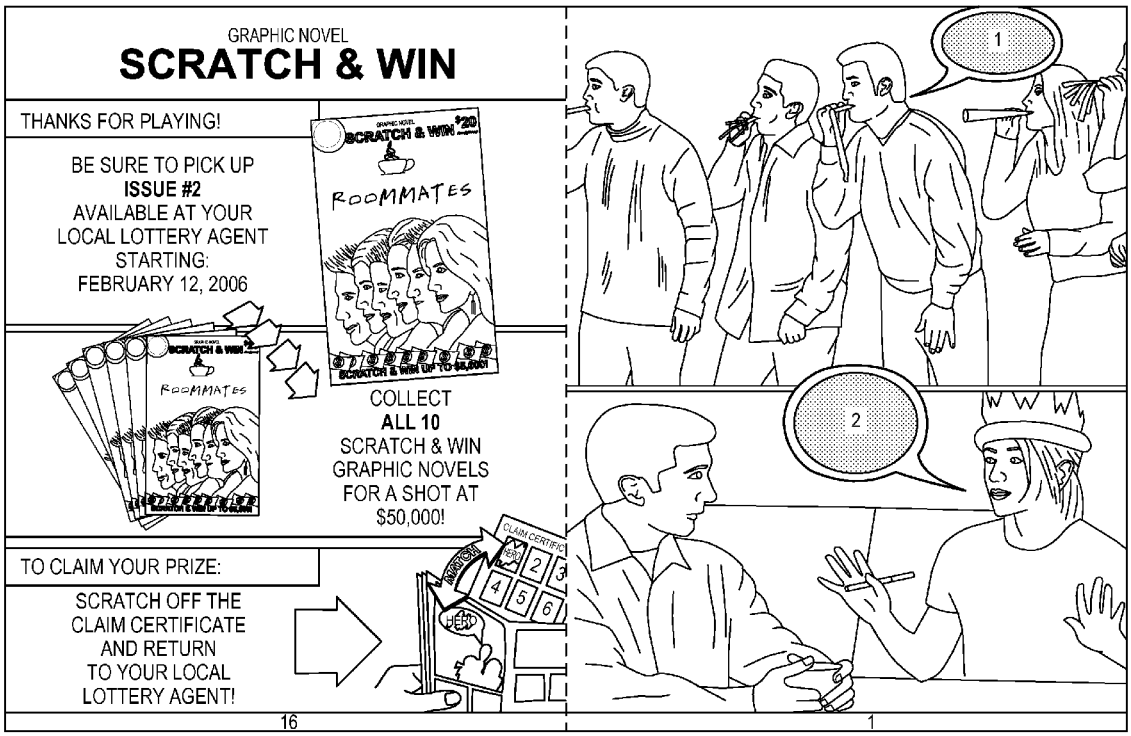
Figure 6D:
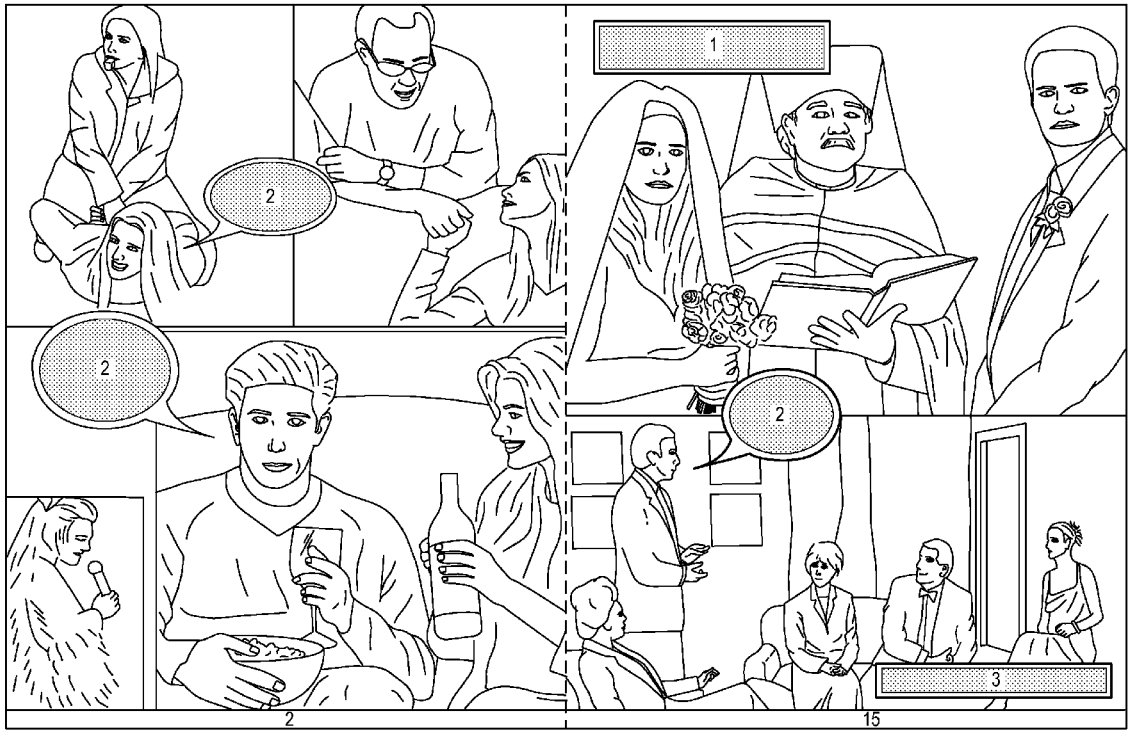
Figure 6E:
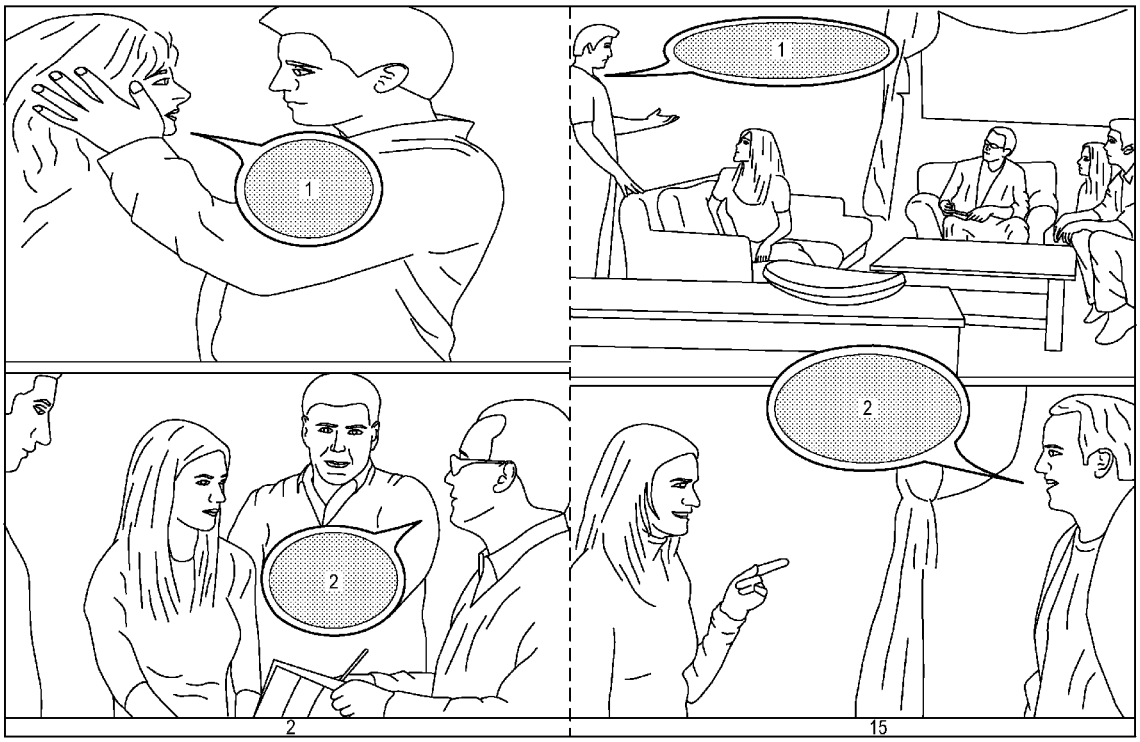
Figure 6F:
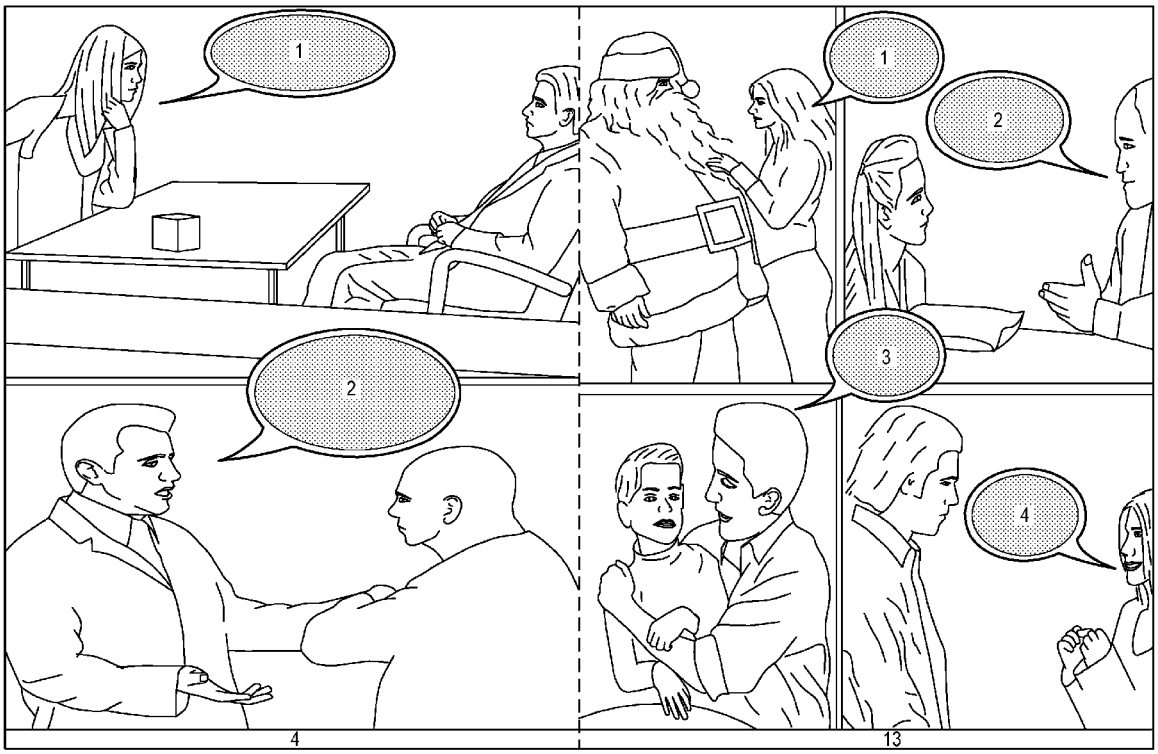
Figure 6G:
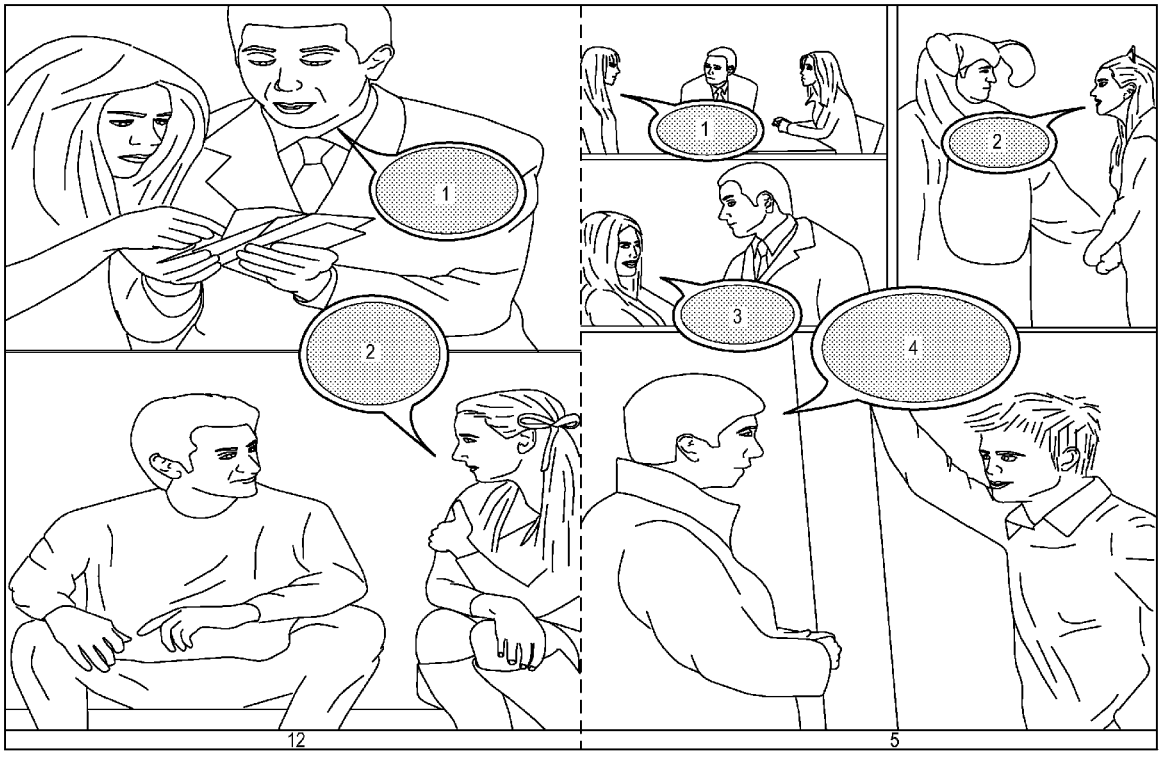
Figure 6H:
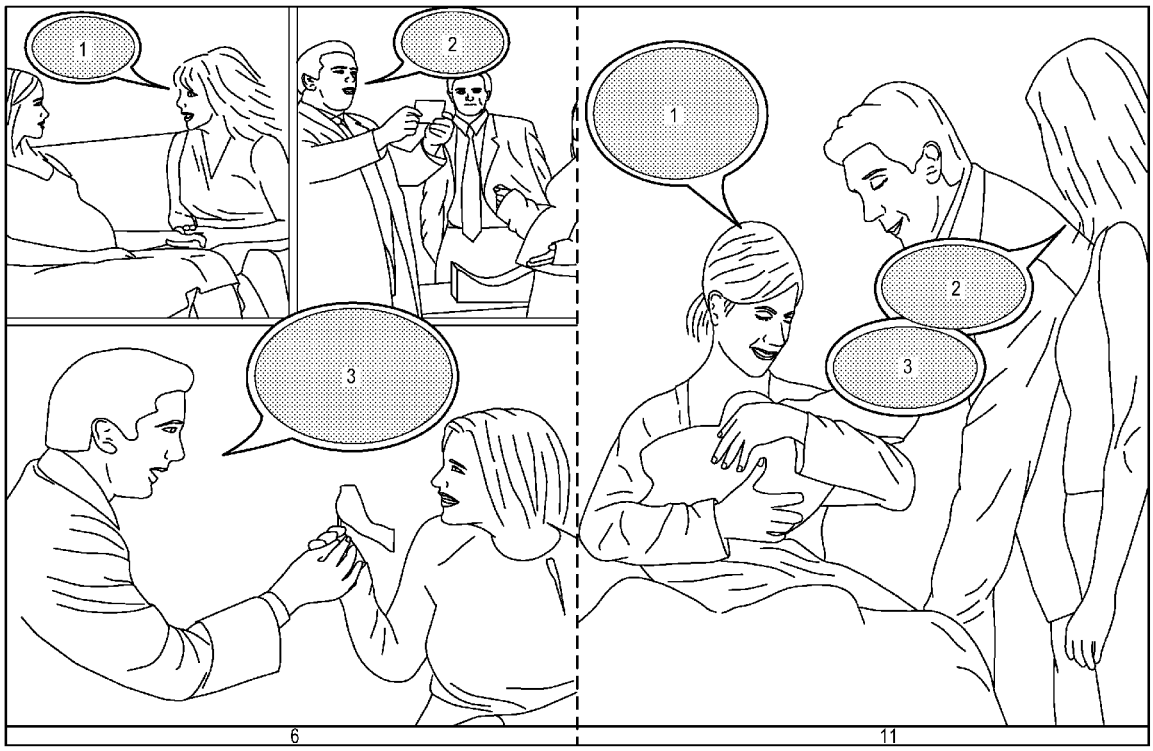
Figure 6I:
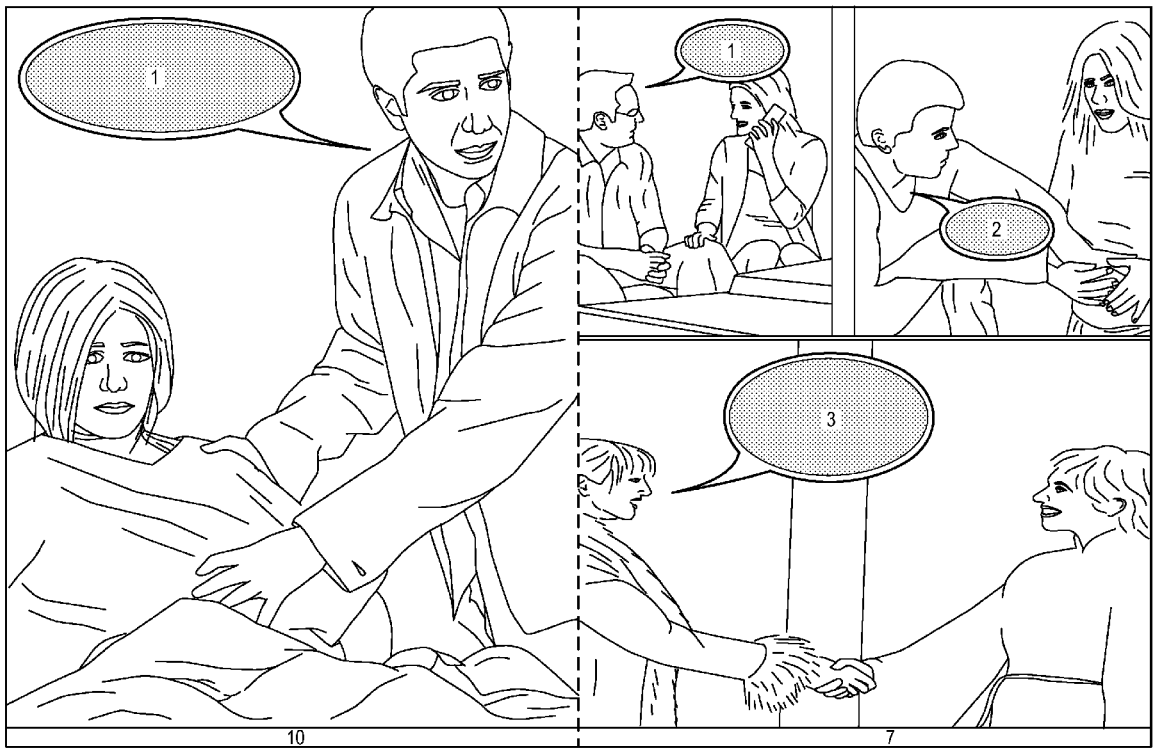
Figure 6J:
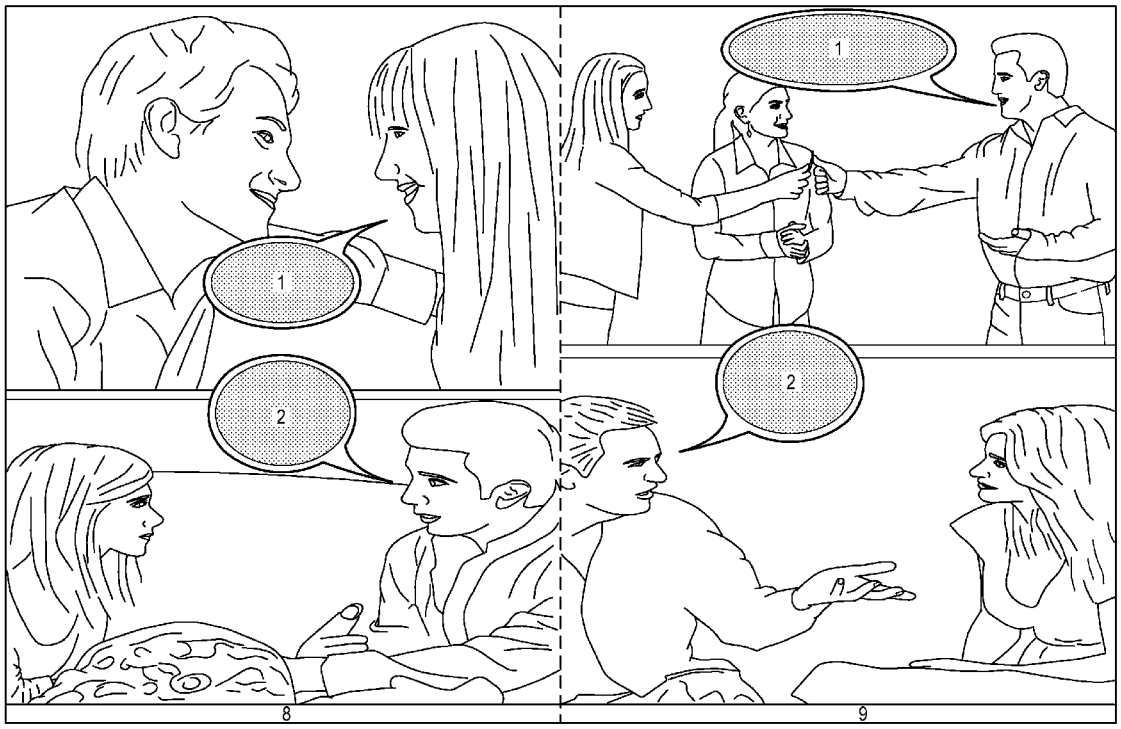
Figure 7C:
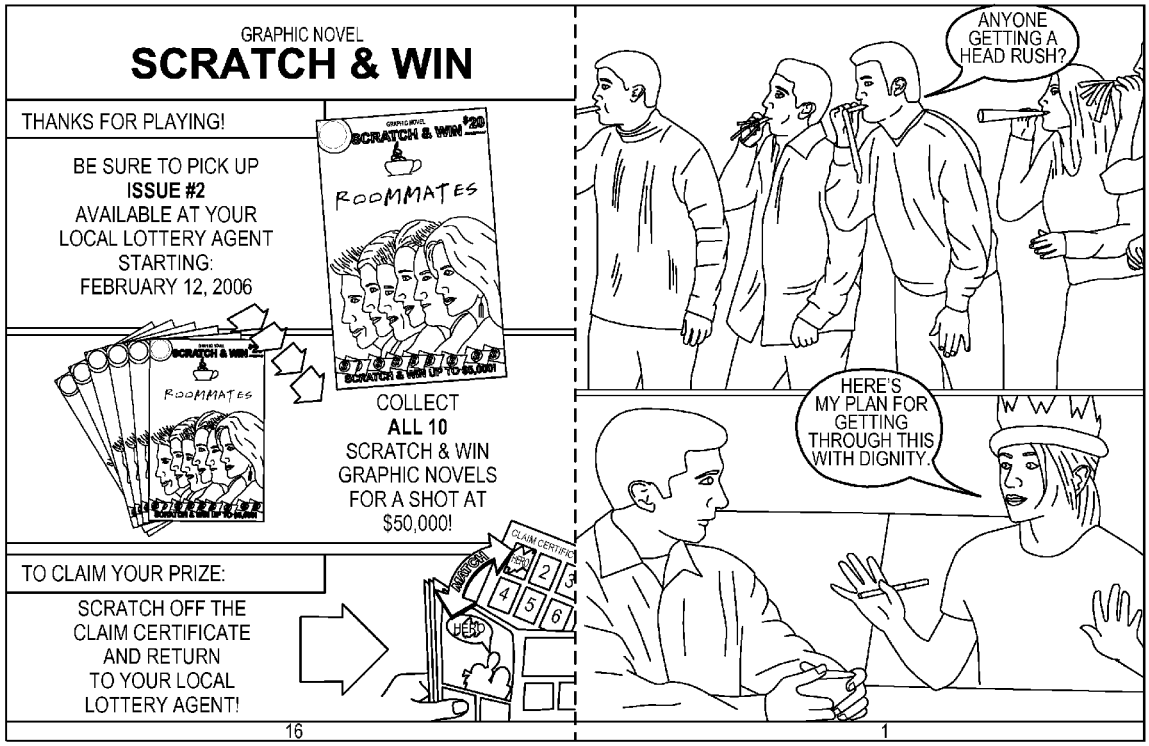
Figure 7D:
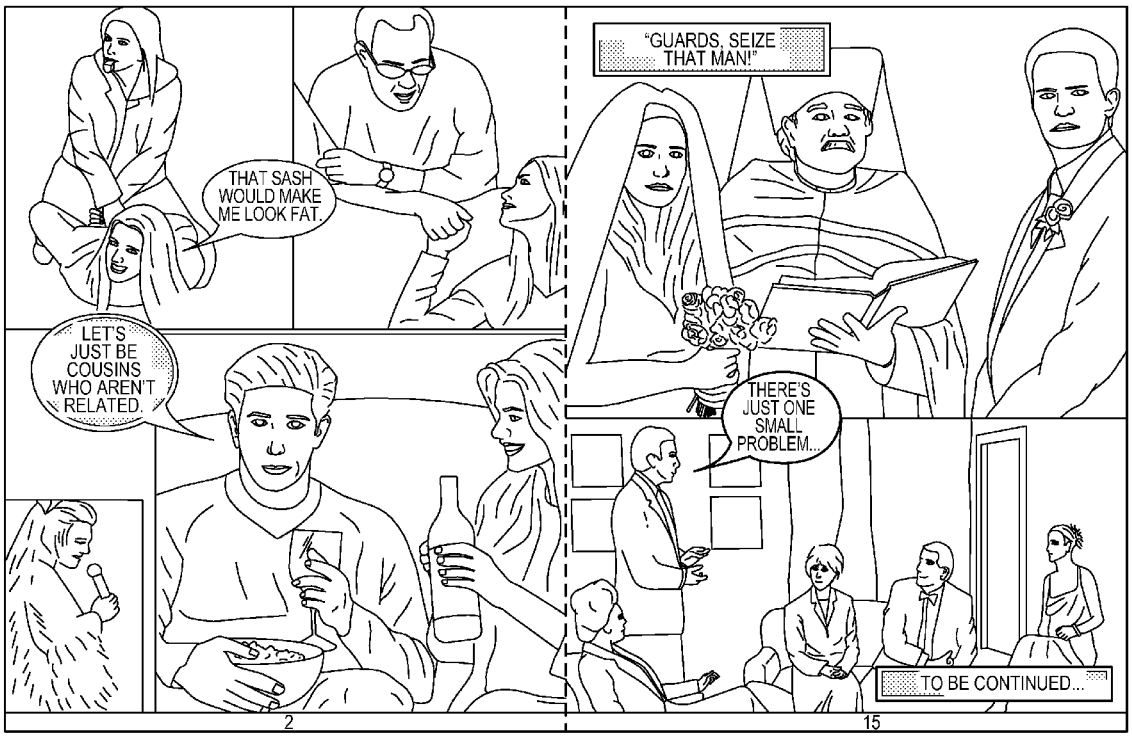
Figure 7E:
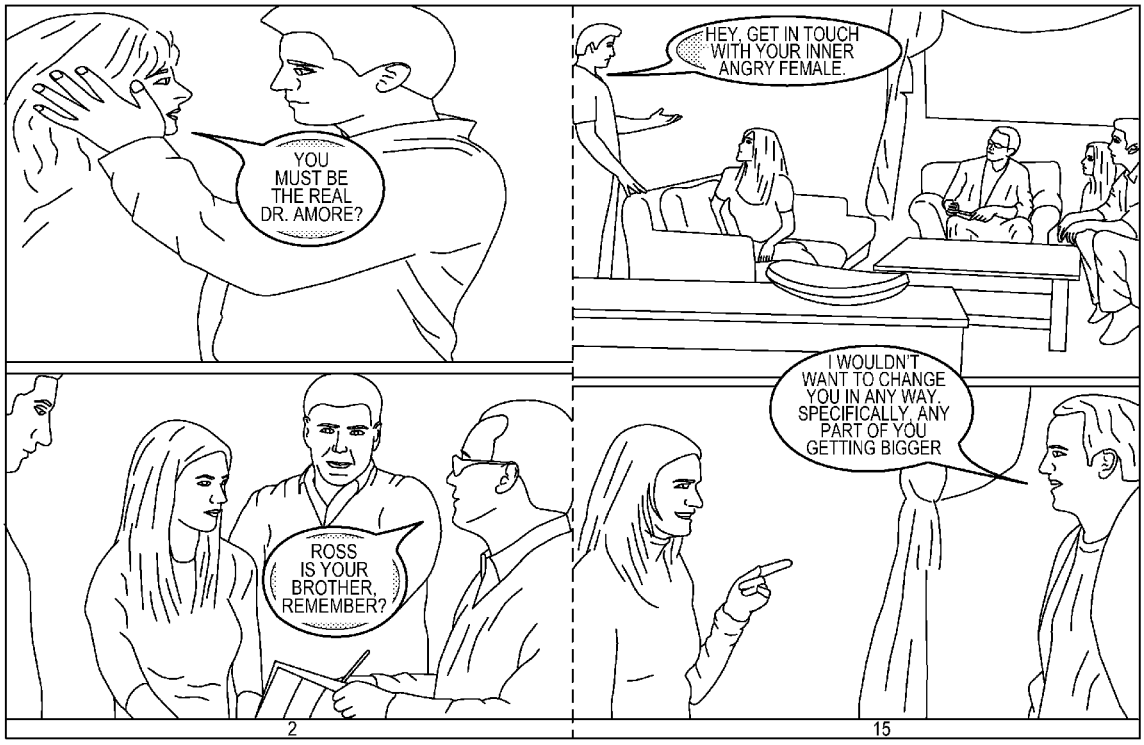
Figure 7F:
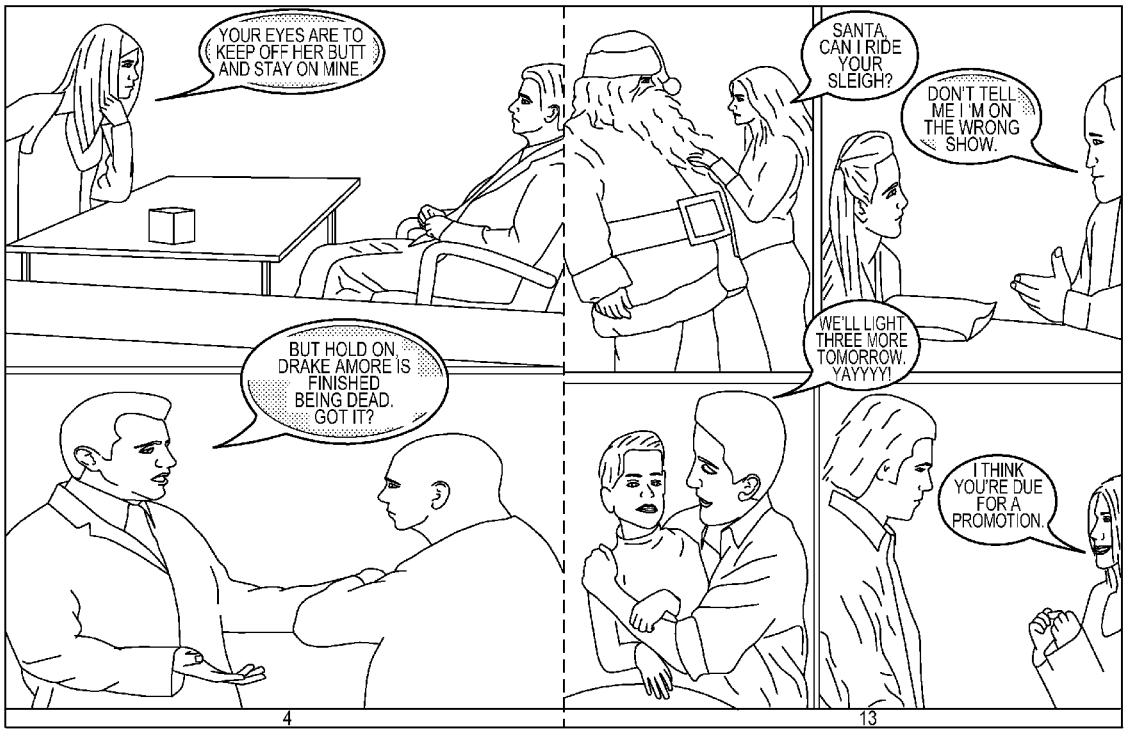
Figure 7G:
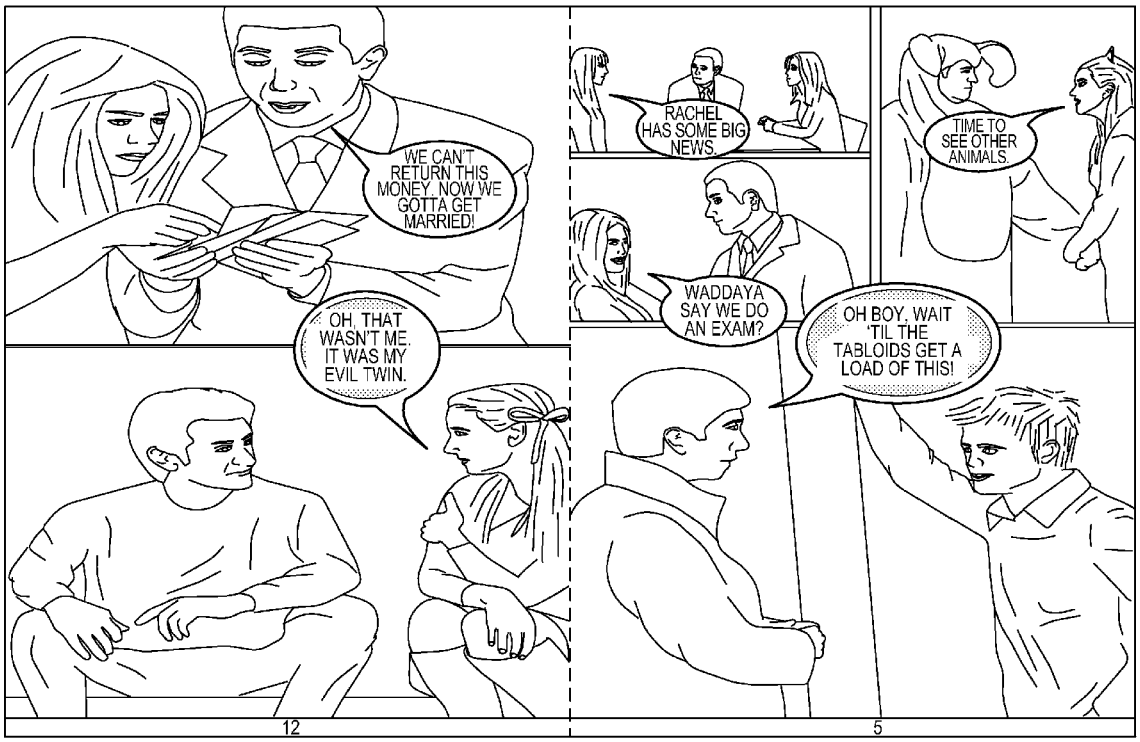
Figure 7H:
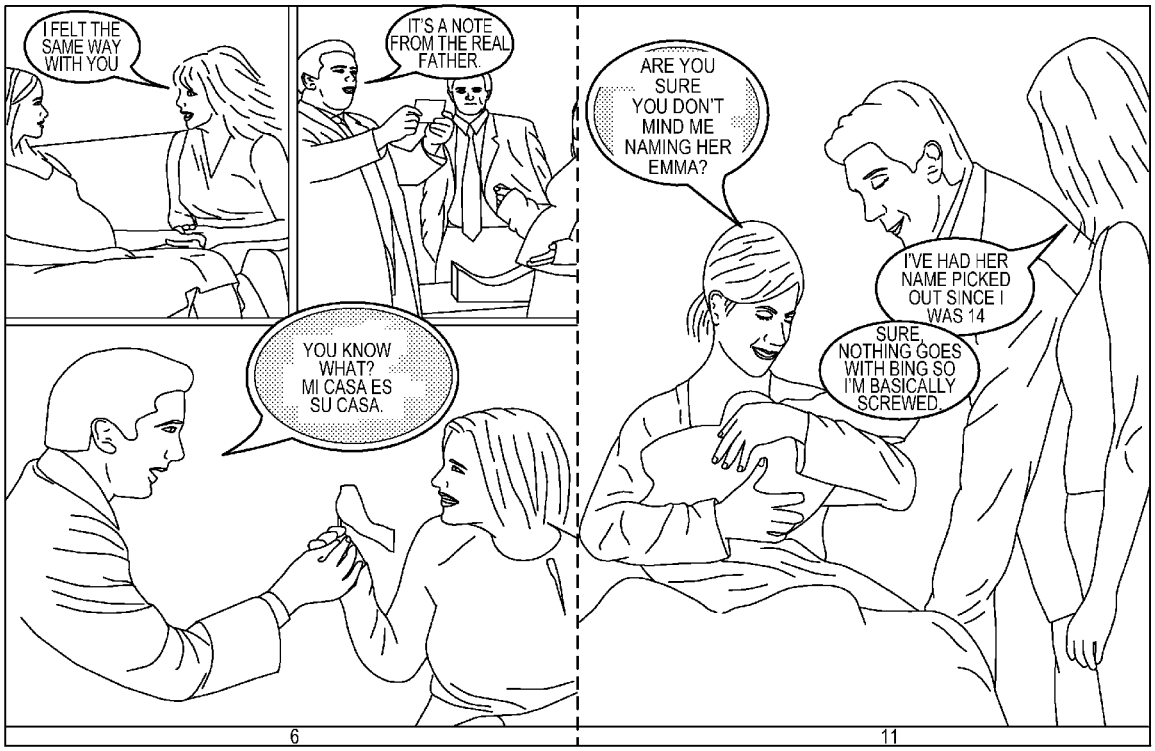
Figure 7I:
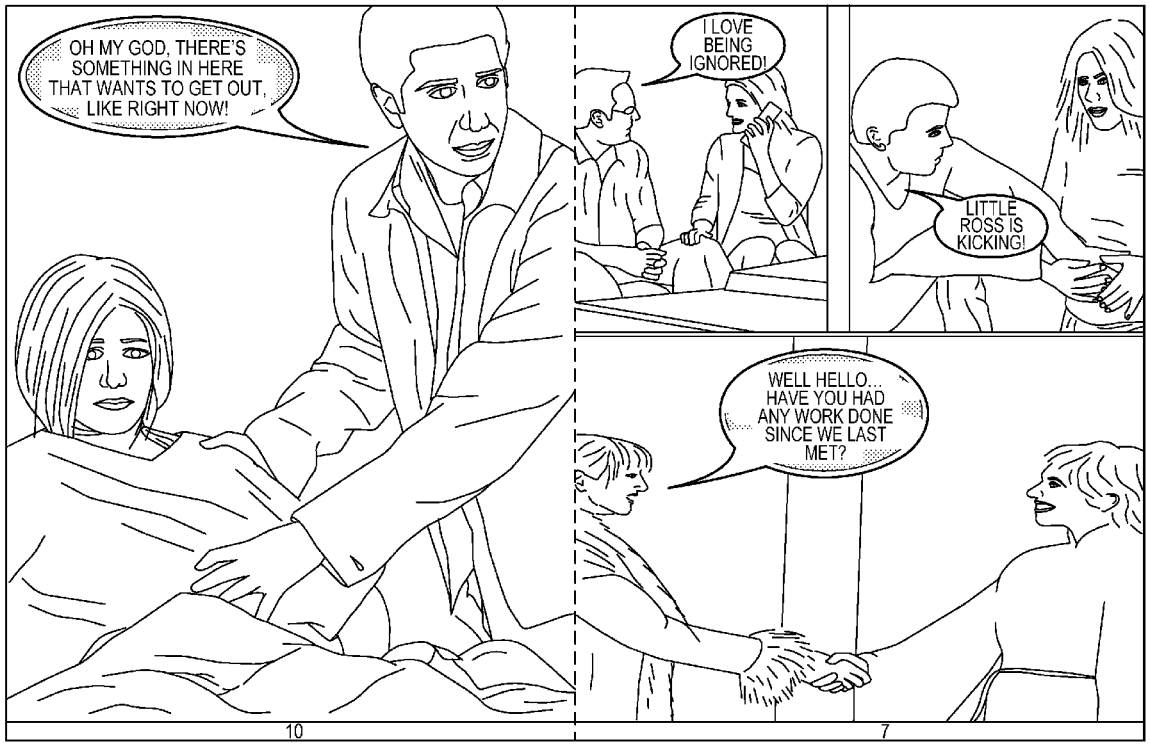
Figure 7J:
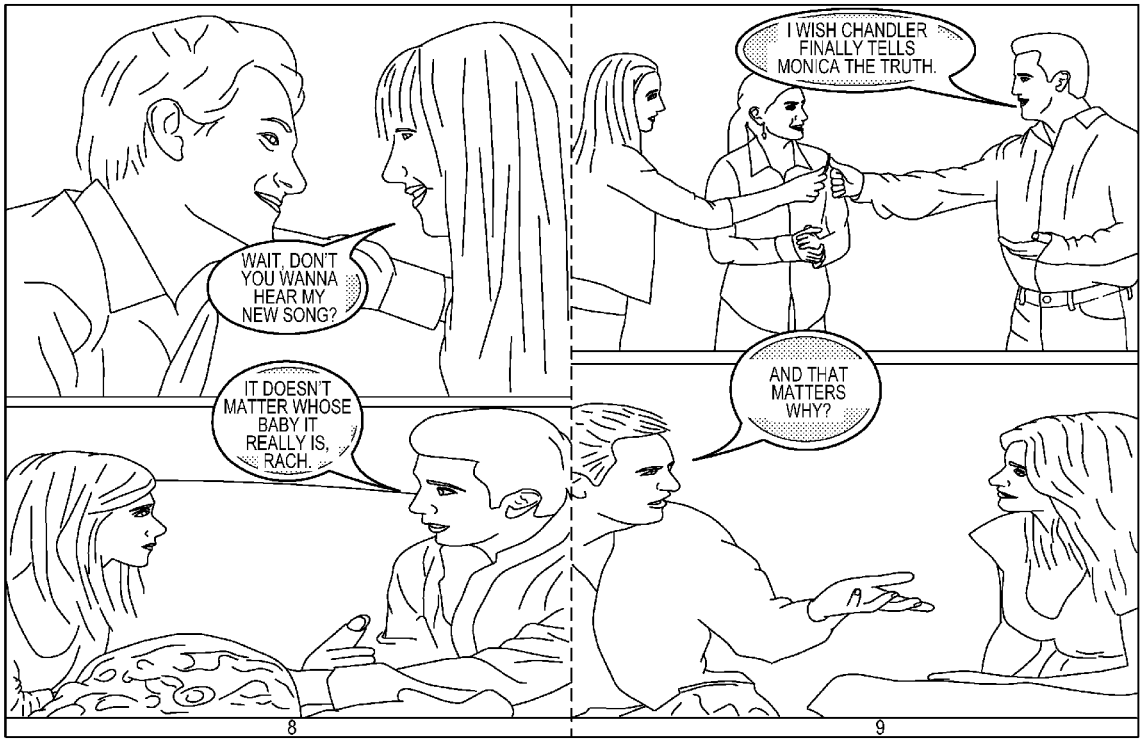

In the depicted example, a claim certificate is provided that includes the plurality of areas including the representations of the values of each page and the representation of the value of the storybook. As depicted in FIGS. 6C and 7C (page 16 of the example), a player should scratch off all of the areas of the claim certificate and go to a lottery agent to redeem any prize for the storybook.

Different storybooks providing the same story may have different paytables (e.g., different words are "winning words" for that storybook). For example, a lottery operator may arrange to have thousands of copies of a storybook produced, in which each storybook has a respective paytable determined, as will be readily understood by those skilled in the art, in accordance with a desired game matrix and/or payout distribution.

Alternatively, or in addition, different storybooks may have slightly or vastly different versions of a story (e.g., the dialog may be different). Some examples of processes, systems, and apparatus for providing customization of printed materials that may be useful, for example, for producing varying dialog or other story elements in different variations of a storybook are described in U.S. Pat. No. 5,765,874, the entirety of which is incorporated by reference in this disclosure.

It is contemplated that additional issues may be provided for different stories and/or characters. Some types of players may find it appealing to be able to read new stories about characters, similar to way in which viewers will follow a television series, or readers enjoy reading about the same character(s) in a series of novels. An example of a series of storybooks is depicted in FIGS. 6C and 7C (page 16 of the example), which advertise "issue #2" of the "ROOMMATES" series of storybooks. FIGS. 6C and 7C also depict an optional advertising feature that suggests that the story included in the sample storybook continues (e.g., in a subsequent issue). Also depicted is a feature according to some embodiments, in which acquiring all of a series of storybooks may make a player eligible for a prize (e.g., via a mail-in drawing).

The example storybook includes a plurality of pages, each page including one or more dialog balloons used to convey dialog of the illustrated characters. For example, FIGS. 6C-6J and 7C-7J each include at least one game/page with dialog balloons having a concealing layer that may be scratched off to reveal the dialog of the characters. By comparing the revealed text with the paytable of the sample storybook, a player may determine whether he has won a prize on that page of the story.

It will be readily understood that none of the features described above and depicted in the example storybook are required, and that various features may be utilized or not as deemed desirable for a particular lottery product. For example, a storybook product may include a representation of the total value of the storybook, but might not include a bonus "phrase that pays" game, etc.

According to some embodiments of the present invention, a lottery product includes a plurality of instant games. Preferably, at least one instant game is redeemable via a conventional redemption process of a lottery (e.g., at a lottery agent for a state lottery authority), and at least one instant game is redeemable at a merchant or business sponsoring that game (e.g., a sponsoring a prize for that game).

In accordance with some embodiments, a lottery product is provided that may be useful in promoting various merchants or businesses. In one embodiment, a lottery product promotes tourism by including, for example, a plurality of instant games sponsored by respective businesses (e.g., tourist attractions, destination resorts).

According to some embodiments, a total payout (or redemption value) associated with a plurality of game tickets may be conveyed to a player over multiple tickets, each of the multiple tickets being independent of another ticket required for redemption.

For example, a game may be provided in which play of the game simulates or represents multiple periods, stages, and/or events in a sporting event, such as a sports game or a race (e.g., soccer, formula 1 auto racing). For instance, individual "events" within a simulated time period or stage of play may be associated with graphical icons, which are then printed onto paper and covered with a concealing agent (e.g. permeated latex, adhesive or perforated paper, etc.). One or more of such events may be associated with a portion of the total redemption value associated with the game. For example, an event that is rare or associated with a relatively high score or advantage in a sporting event may be associated with a relatively high payout, and a failure or disadvantage in the simulated game (e.g., being stuck in a sand trap in a golf game) may be associated with a low, negative, or zero payout.

For example, a redemption value may be associated with a plurality of game tickets configured or produced to replicate the game of baseball, with each of nine separate tickets or games each representing an inning. For example, each "inning" of play may be associated with and configured or produced to convey a portion of (a sub-payout of) a total redemption value associated with the game. Further, each inning may be associated with an inning result representing a portion of the total redemption value of the game.

For example, a representation of a baseball scorer's sheet may be employed to convey a simulated baseball game to a player. More specifically, individual "events" within an inning (e.g. outs recorded, hits, runs, etc.) may be associated with graphical icons, which are then printed onto paper and covered with a concealing agent (e.g. permeated latex, adhesive or perforated paper, etc.). One or more of such events may be associated with a portion of the total redemption value associated with the game. For example, a grand slam may be associated with a +$10 payout, and a strikeout may be associated with a $0 payout.

Accordingly, as used herein, the occurrence of various events within a simulation of a game or event (e.g. a game of baseball, a horse race or series of horse races) may equate to various events, happening, words, phrases, props or types of props occurring with the context of a story (e.g. a graphic novel, comic book, or comic book series).

Figure 8A:
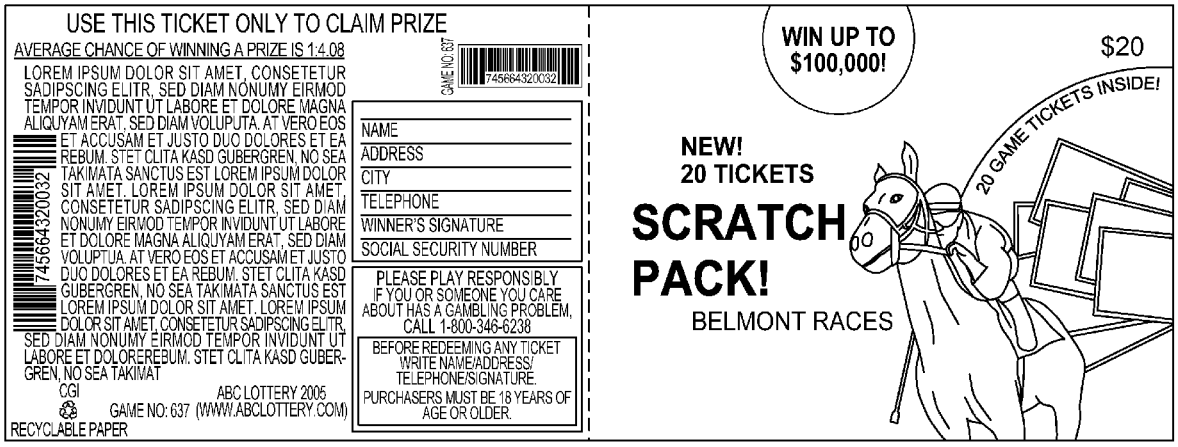
Figure 8B:
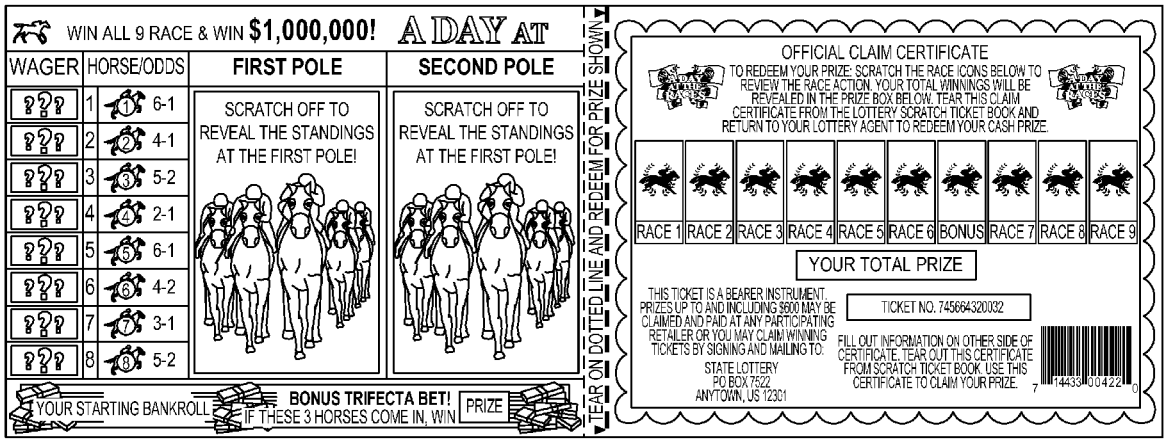
Figure 8C:
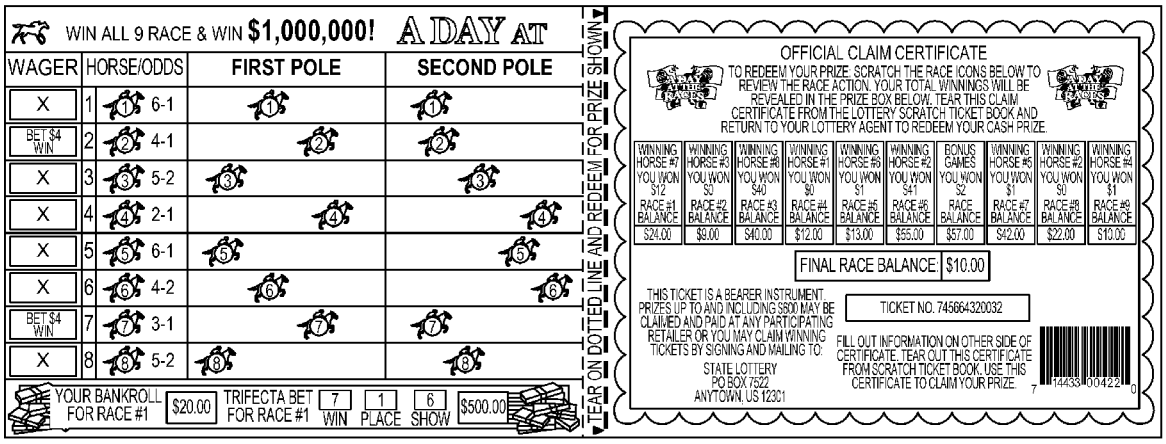
Figure 9A:
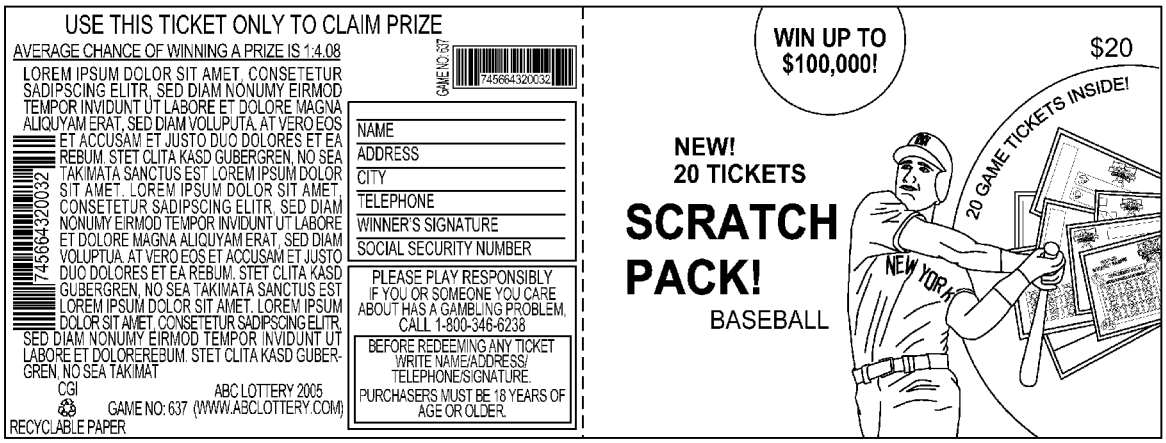
FIGS. 9A-9*l* illustrate an embodiment of a lottery product.
Figure 9B:
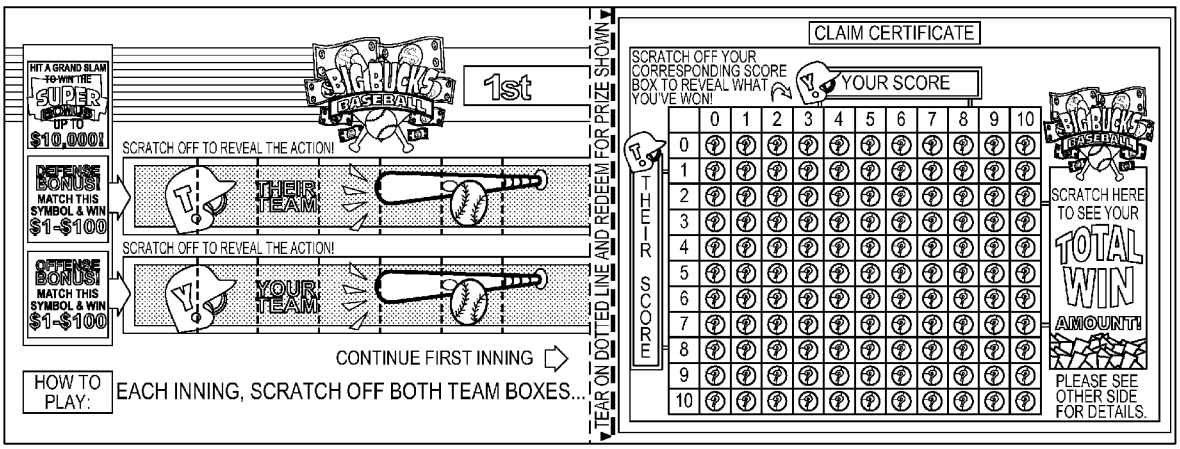
Figure 9C:
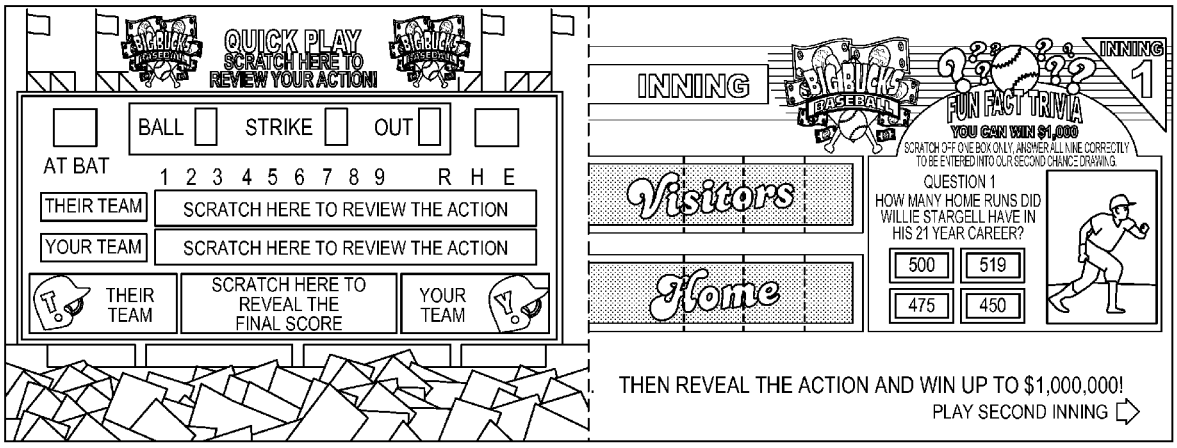
Figure 9D:
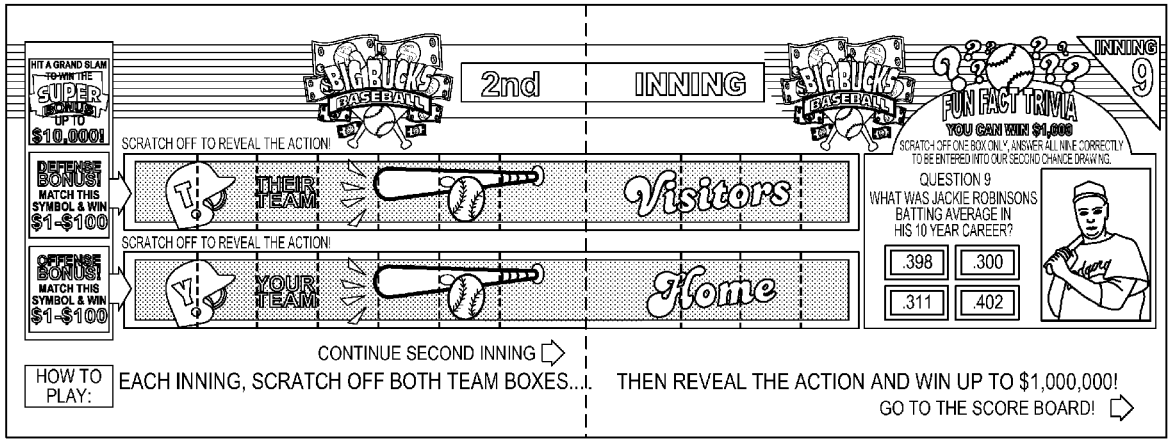
Figure 9E:
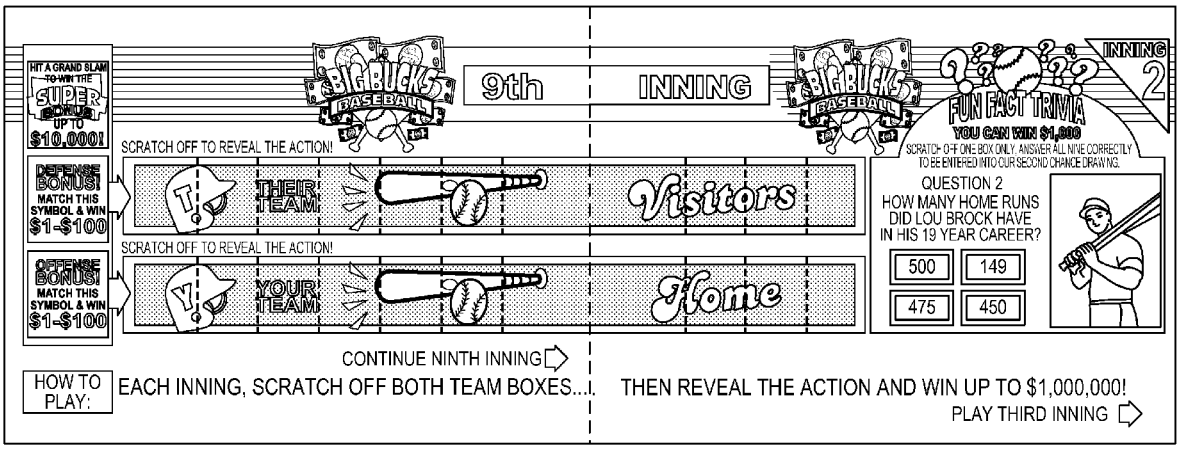
Figure 9F:
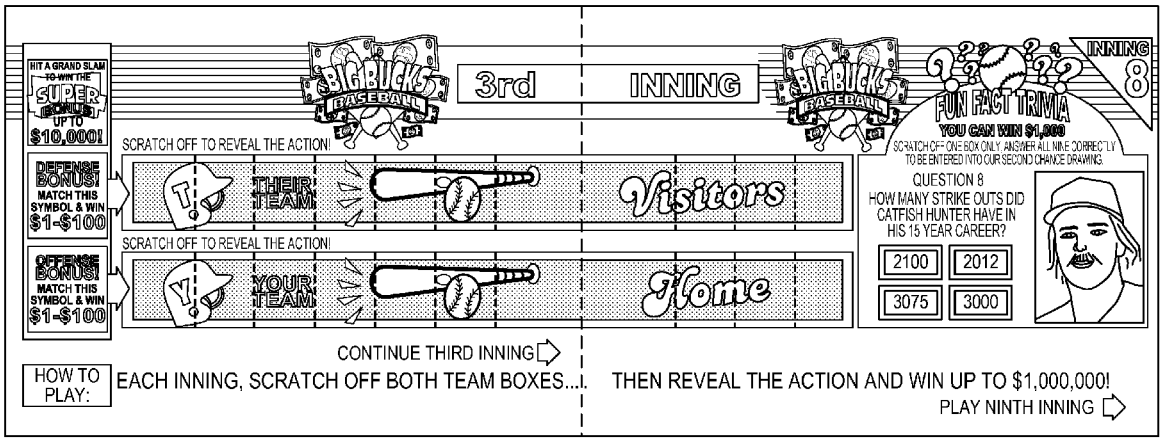
Figure 9G:
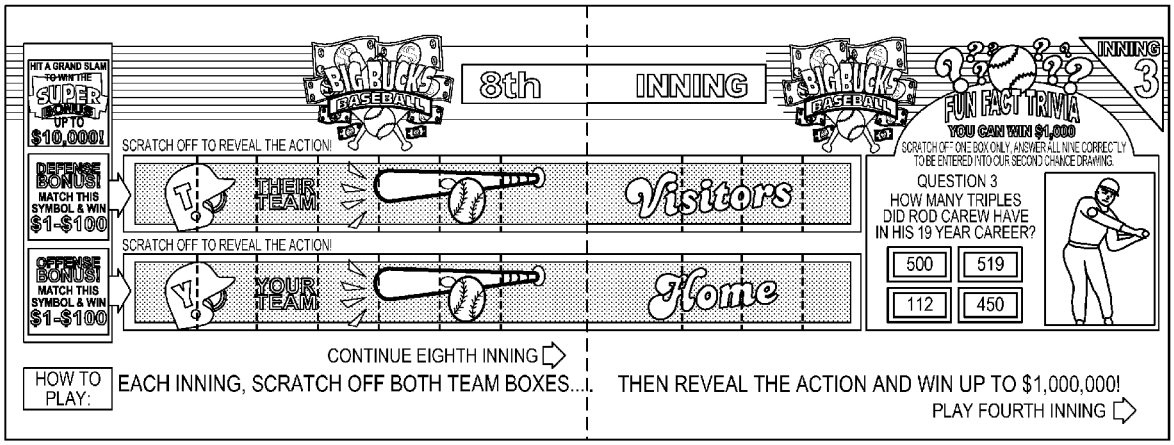
Figure 9H:
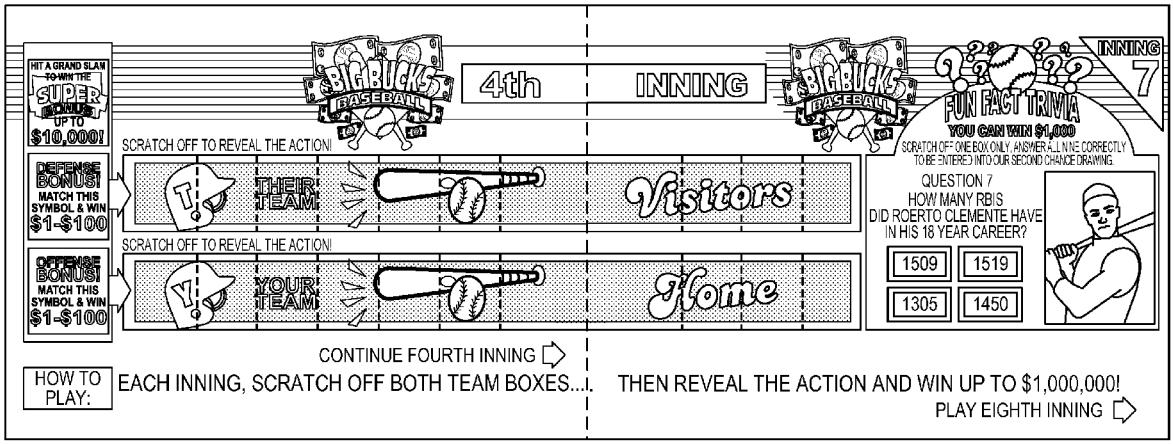
Figure 9I:
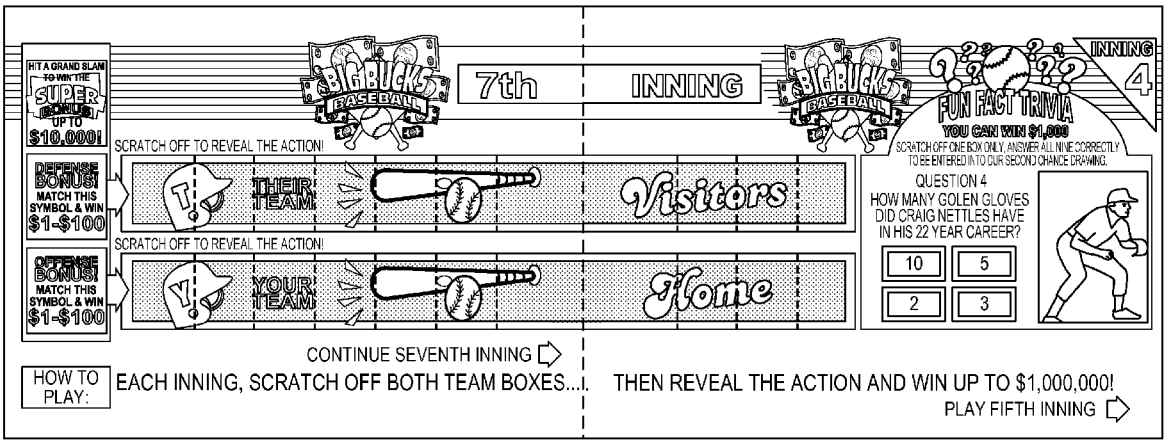
Figure 9J:
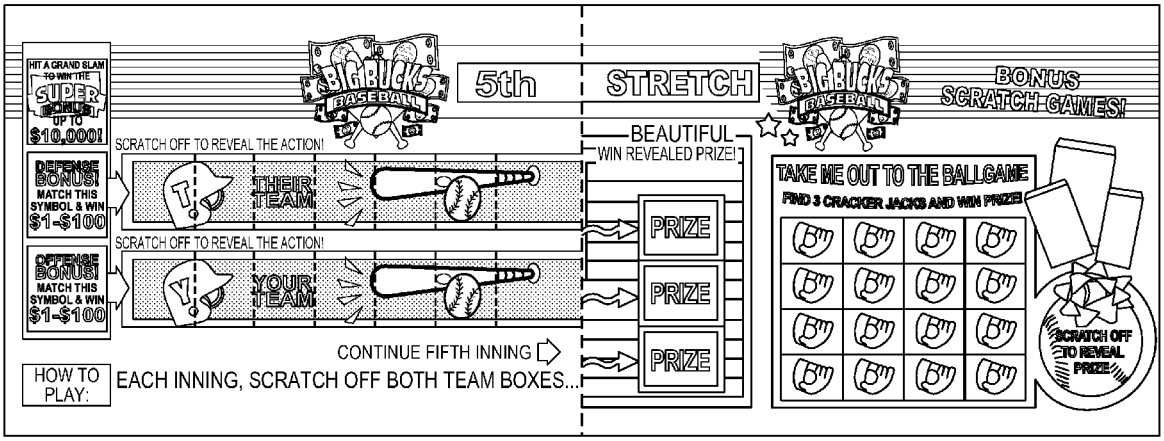
Figure 9K:
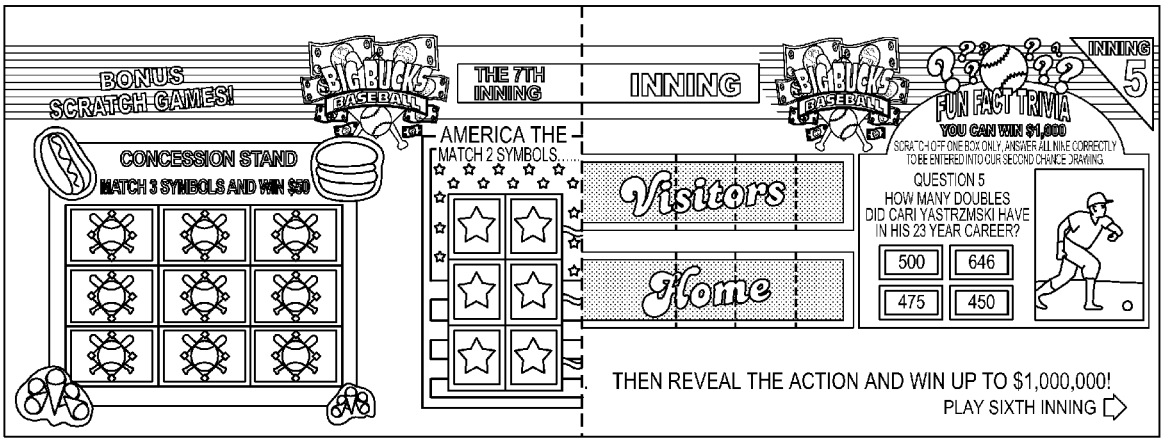
Figure 9L:
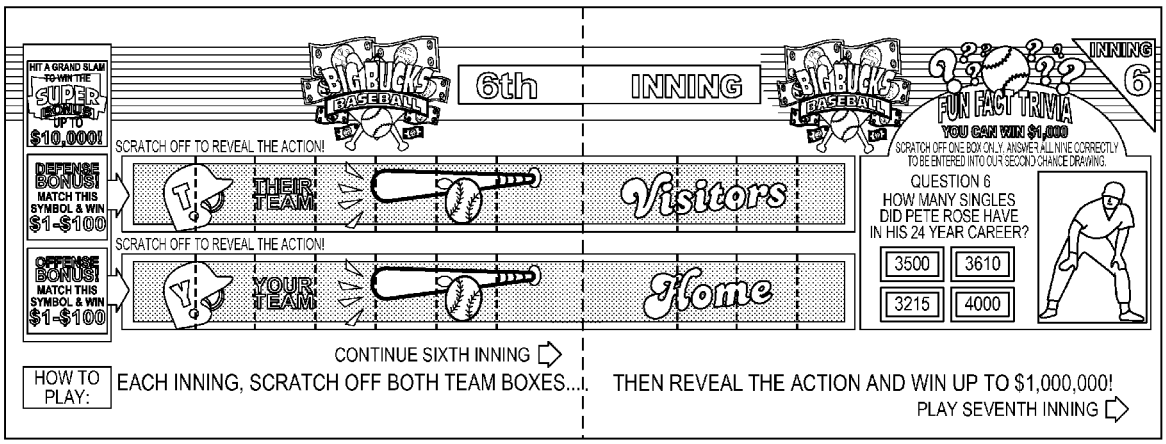
Figure 10A:
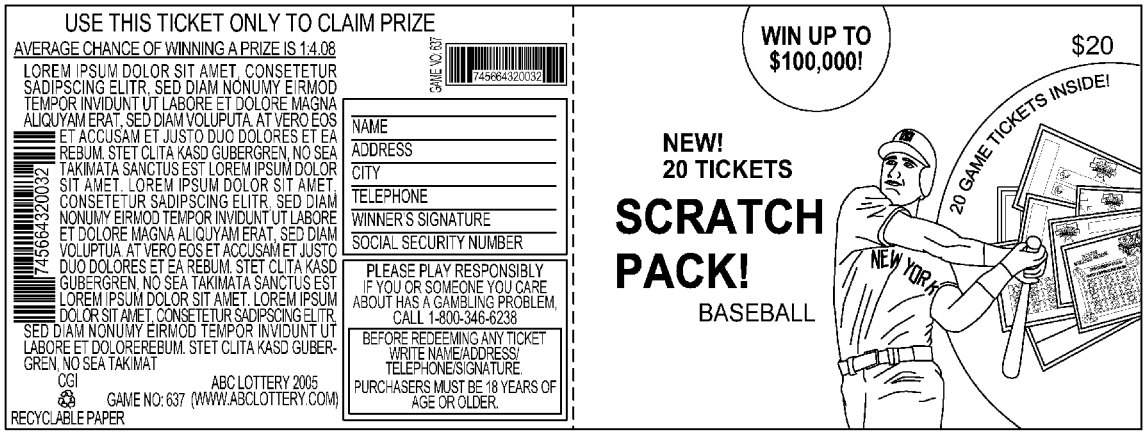
FIGS. 10A-10*l* illustrate an embodiment of a lottery product.
Figure 10B:
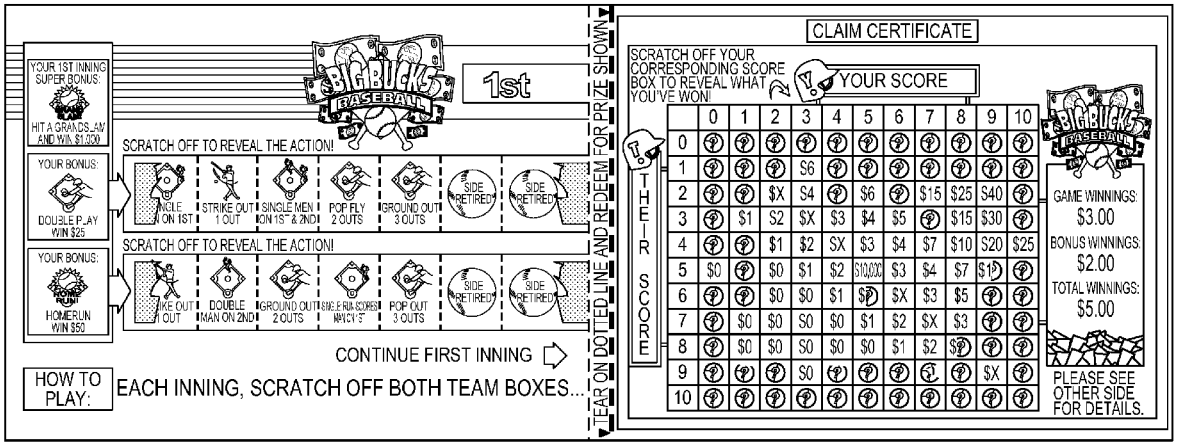
Figure 10C:
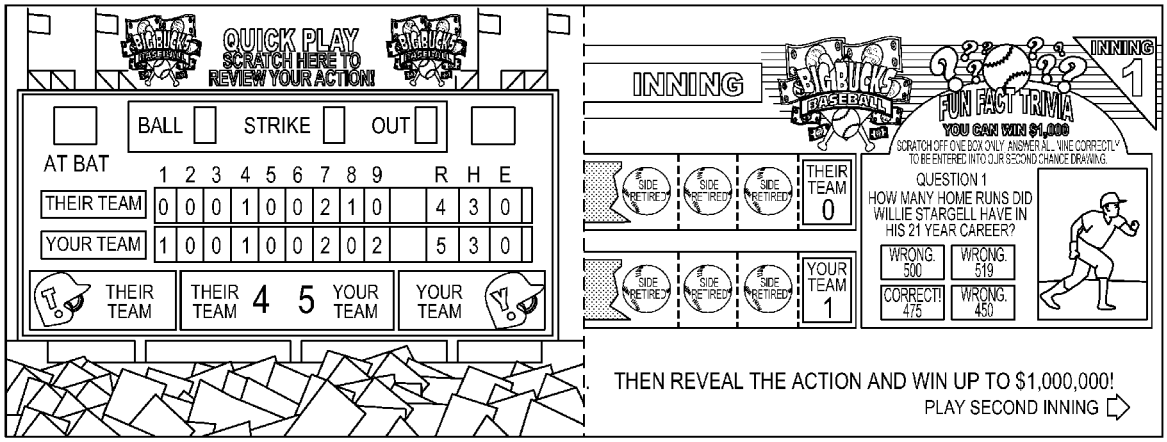
Figure 10D:
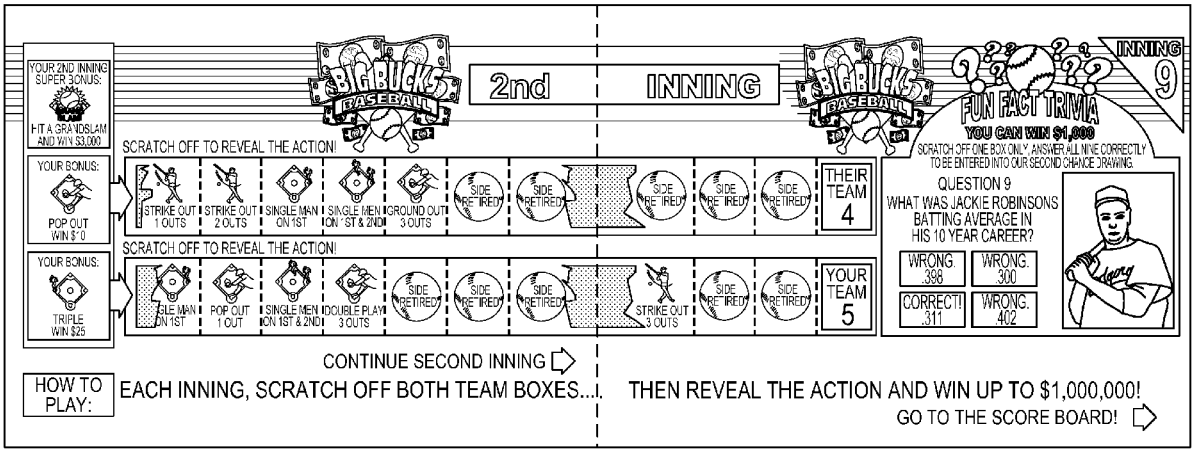
Figure 10E:
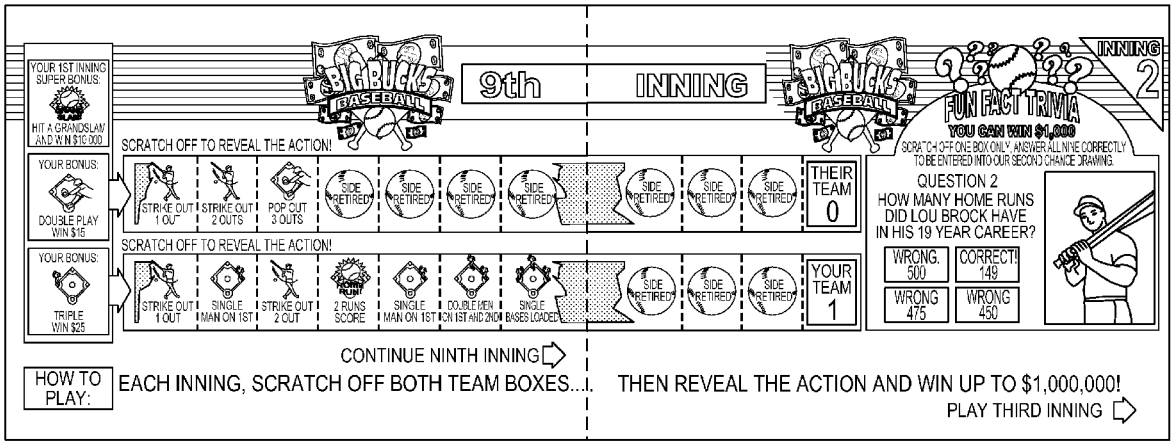
Figure 10F:
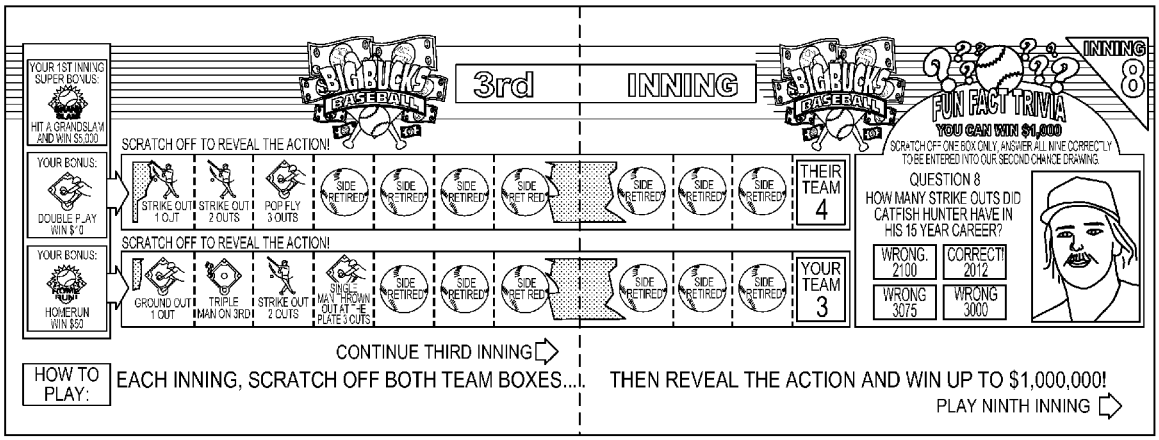
Figure 10G:
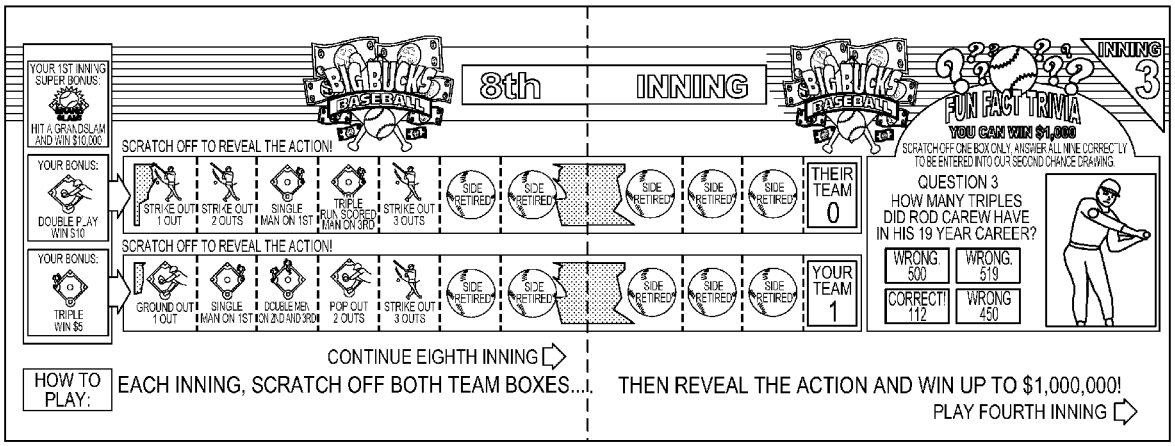
Figure 10H:
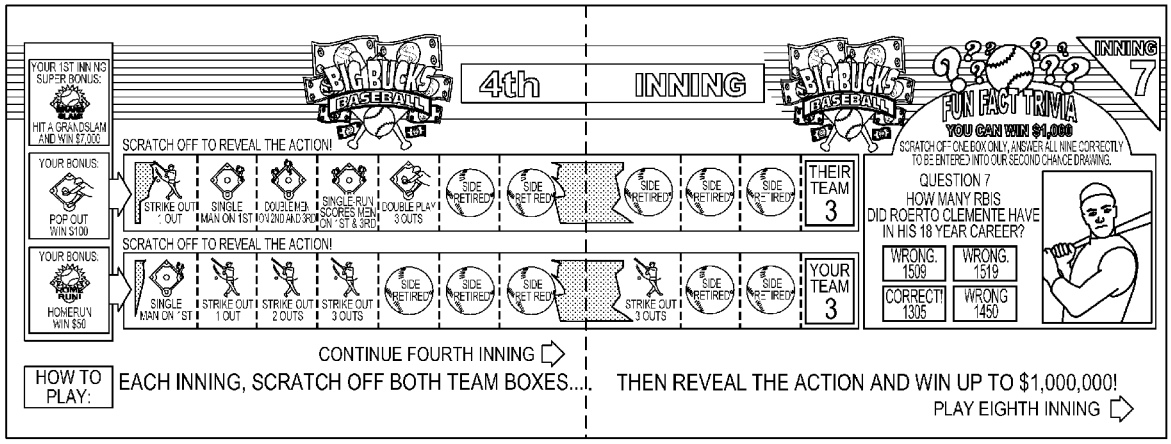
Figure 10I:
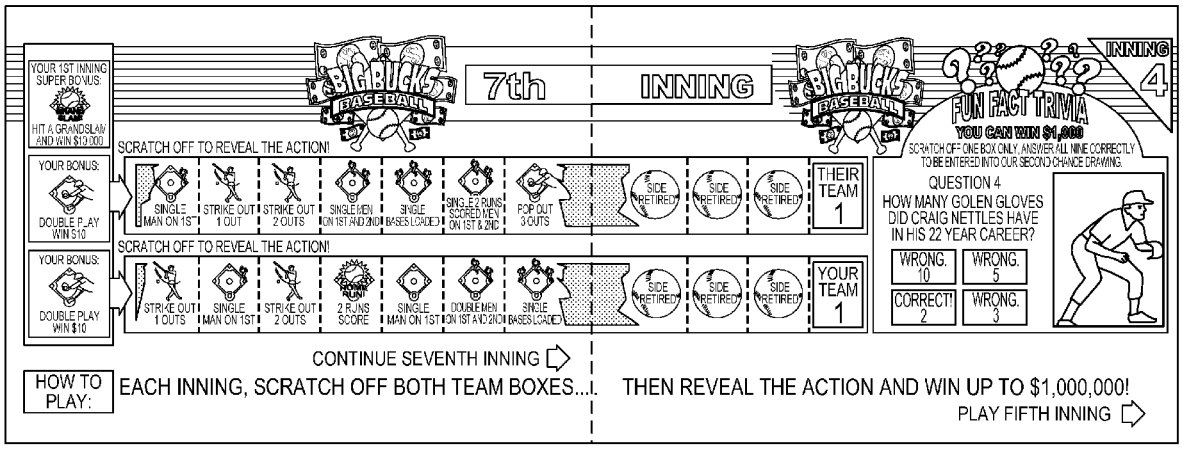
Figure 10J:
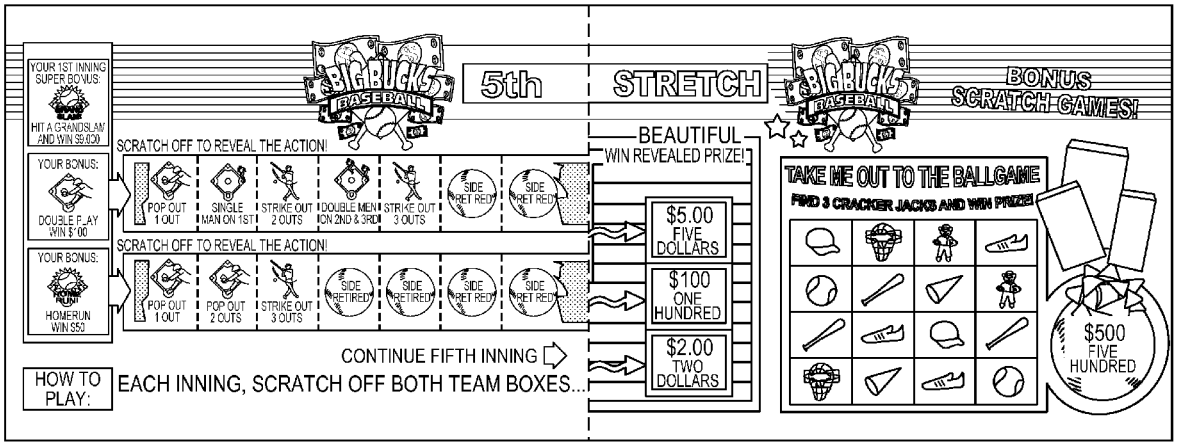
Figure 10K:
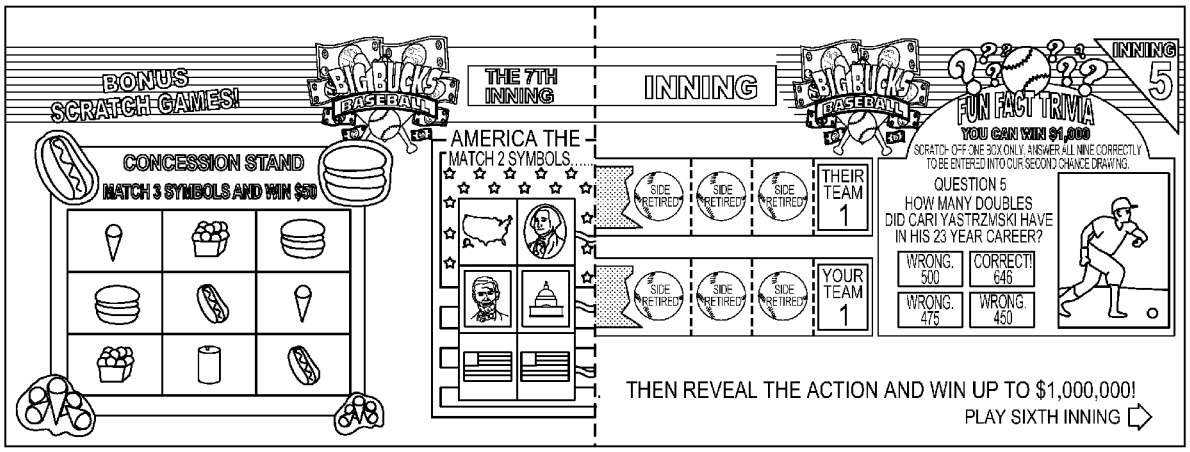
Figure 10L:
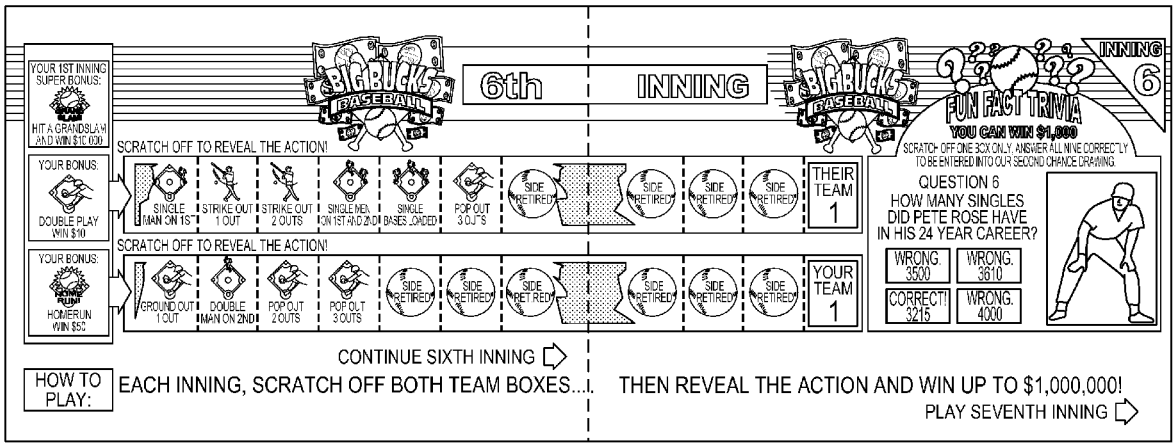

FIGS. 8A-8D illustrate various examples from a lottery product associated with a series of horse races (for simplicity not all pages of the lottery product are shown). Within such a context a running count summing a plurality of sub-payouts (e.g., winnings from respective races) may be carried-over from one simulated race to the next (e.g., represented as a current bankroll of the player available for wagering), with the ultimate redemption value of the product being equal to the final sum of all sub-payouts (positive, zero, or negative). For example, FIG. 8B illustrates an example of a starting bankroll that is initially covered, while FIGS. 8C and 8D indicate the (predetermined) revealed starting bankroll for each race depicted in the product. As illustrated in FIG. 8D, an initial bankroll of $24.00 was reduced by a wager for race #2 of $15.00, and the player did not win anything in race #2, resulting in a running balance of $9.00. A running count (and the representation thereof) may be useful in accordance with some embodiments for providing the excitement of having a player's fortunes change from round to round (i.e., race to race, or ticket to ticket). In accordance with some embodiments, a final redemption value may itself be a negative value, in which case no positive value or payout may be associated with the product (i.e. the redemption value of the product may be equal to zero).

FIGS. 9A-9L and FIGS. 10A-10L include various illustrative examples of a simulated game of baseball. Generally, FIGS. 9A-9L depict an example storybook in which none of the concealed locations has been revealed (e.g., scratched or played), and FIGS. 10A-10J depict the same storybook as if all of the revealable locations of the storybook were revealed.

As described above, one or more events occurring within a story may be associated with a negative sub-payout. For example, in a simulated game of baseball, a run scored by the opposition may be associated with a payout of −$2.00. Accordingly, any occurrence of a negative payout within the context of a given series of events may adversely affect a running count of sub-payouts ultimately comprising the total redemption value associated with the product. For example, over the course of several events, a player may accrue both positive and negative sub-outcomes, with the sum of all positive and negative sub-payouts ultimately being equal to a final redemption value associated with the product.

According to some embodiments, a product based on a story may be such that the story is entirely fiction-based. For example, a game may be based on an illustrated story comprising multiple fictional travel segments. According to other embodiments, a product designed based on a story may be such that the story is not entirely fiction-based or may be even entirely fact-based. For example, a lottery product may include games based on state history, or other factual topics, including various facts and information associated therewith. In some embodiments, game symbol indicia may be contextually or thematically connected to the facts or information provided within the product. For example, stories or information concerning the history of aviation may be associated with game symbols representative of aviation in general.

As described above, in accordance with some embodiments, the redemption value of a given product may correspond to a product or service (e.g. merchandise, travel or lodging, etc.). Thus, according to some embodiments, information (e.g. promotional and/or product information) from one or more third parties may be included in or on the product itself. For example, a lottery product may comprise multiple games that include game symbol information and/or information corresponding to products or services that may be conferred to a player in lieu of, in addition to and/or as a substitute for a cash redemption value. Thus one or more third parties (e.g., merchants, businesses, retailers) may effectively promote their product or services within the context of one or more lottery products.

For example, game symbol information may be associated with a particular third party and/or third party product or service, such that the occurrence of certain game symbols within the context of a given game may correspond to such products or services (e.g. transportation, travel upgrades or services, merchandise, etc.). Accordingly, in consideration of promotional placement of third part products and services, some or all of the cost of product production may be off-set by a given game/product provider. For example, a game provider may partner with a travel services provider, such as a cruise line, in order to produce combination game/promotional products.

According to some embodiments, a total redemption value associated with a given product may represent a total discount toward third party products and/or services. Alternatively, or in addition, a given product may be associated with both: (i) a cash redemption value; and (ii) a product discount value in excess of the cash redemption value. For example, a given product may have two separate redemption values including e.g. $15.00 in cash or (ii) $50 off a two-day rental from "ABC Rent a Car".

In accordance with at least one embodiment of the present invention, a product for promoting tourism comprises (a) a plurality of first instant games, in which each first instant game being sponsored by a respective sponsor, each first instant game is provided on a respective page, and each first instant game comprises a chance for a prize redeemable at the respective sponsor; and (b) a plurality of second instant games, each second instant game being for a prize redeemable from a lottery authority (or an agent thereof).

According to some embodiments of the present invention, an instant lottery game (and method for producing said game) are provided, in which a player (or other individual) may determine the total redemption value of the lottery game in one or more of a plurality of ways. For example, a redemption value may be determined by submitting an instant lottery game piece (e.g., a scratch ticket) to a lottery agent in a conventional redemption process. Such a process may use, for example, a bar code or indicia on the instant lottery game and may utilize communication between a terminal at a retailer or other type of agent and a server or other computing device of a lottery authority in communication with the terminal. In another example, a player may determine a redemption value by playing all of the playable areas of an instant lottery game and determining the redemption value based on rules of the game. For instance, a player may scratch off a concealed portion of a ticket to reveal player indicia and/or winning indicia and determine the redemption value based on the revealed indicia. In another example, a redemption value may be determined without necessarily playing all or any portion of the game. For instance, as discussed in this disclosure, a game may include a representation (e.g., concealed) of the actual redemption value of a game (and/or the total redemption value of a plurality of games), such that a player can determine the actual value of a game without, for example, scratching off any other concealed game areas.

According to some embodiments of the present invention, a lottery product comprising a plurality of outcomes is provided in which a player may experience excitement, tension, etc., by providing for a mix of low and high outcomes, or negative and positive outcomes, etc., across the plurality of outcomes. For example, a product may tell a story or convey a simulated sporting event such that there are emotional ups and downs and perhaps a cliffhanger of some kind that resolves itself in the last outcome (e.g., the last simulated inning of a baseball game).

According to some embodiments of the present invention, a pack or booklet of thematically "connected" scratch tickets may be made available for purchase at a single price. In one example, a game-based set of tickets allows a player to reveal a series of game-related events as he scratches through the various tickets in his booklet. In one embodiment, the tickets work together as a group. For instance, each individual ticket incorporates one or more scratch-off areas just like standard tickets, but over the course of the booklet the tickets lead up to a final result of the game. In one embodiment, this final result, not any individual ticket, determines the prize won by the player, if any.

In one example, each ticket represents a complete inning of play of a baseball game that simulates the player as the home team playing a nine-inning baseball game against a visiting team. To play, the player scratches and reveals each at-bat during each inning. For instance, the player could first scratch off the visitor at bats until the visiting team accumulates three outs. Then, the player would scratch off his at-bats until he gets (i.e., reveals) a total of three outs. Play continues for nine innings worth of tickets. For instance, the home team might be ahead by a score of 4 to 1 in the third inning, be losing 5 to 4 in the eighth, and pull out a 7 to 5 victory on a two-run homer in the bottom of the ninth inning.

In one embodiment, the amount of money won for a set of tickets with a game theme depends on the final score. In other words, winning 7 to 5 in a baseball game may have a different payout compared to winning by a score of two to nothing.

In one embodiment, the final page of a pack or booklet of tickets incorporates a detachable claim certificate (e.g., including a bar code) that a player can redeem at any lottery agent. Preferably, this last ticket or page is the only ticket with any redemption value. Thus, all of the other tickets in the booklet are for entertainment purposes only and these multiple play tickets cannot be cashed in separately.

In another game-based example of a set of tickets, instead of innings in a baseball game, each ticket is for a different horse with its own preset wager. The player wins and loses races as in a real day at the track and then discovers his winnings based on his net balance, if any, at the end of the ten races.

In another variety of packs of tickets, a player is able to follow a storyline from page to page, much like a graphic novel. For example, the player scratches off dialog boxes in the story. The words in the dialog are then compared to a set of winning words that are scratched off on the inside back cover of the booklet. In one embodiment, the winning word list varies from booklet to booklet (but the story is the same). The random word list determines if the player is a winner, and if so, how much he has won.

In another example of a story-based group of tickets, a plurality of tickets can be used to tell the story of the State's history—helping to promote the unique heritage of each state. Each ticket, for example, could tell a different episode from the state's past.

In another variety of packs of tickets, a booklet includes pages that are advertisements from leading companies or attractions in a state or other jurisdiction—such as tourist destinations or retail stores in major malls. According to some embodiments, sponsors not only pay the state lottery for their pages, but they may offer players bonus promotional prizes and discounts on special scratch-off areas on the ad pages themselves. These bonus prizes are provided solely by the advertiser and may cost the state nothing, though they may add real value to every booklet. Such packs may help a state promote its tourist destinations, for example, by offering instant-win discounts to major attractions, for example, Sea World or Universal Studios in Florida.

According to some embodiments, lottery products are provided that can be made to use current validation methods, current channels of sales through lottery agents and vending machines, current redemption practices and so on.

According to some embodiments, a plurality of tickets offered as a lottery product for a single purchase price may be shrink-wrapped or sealed with a tear-off strip (e.g., and sold side-by-side with traditional scratch tickets that are already on the market).

According to some embodiments, a product and processes are provided for allowing for a set of connected scratch tickets that do not have individual redeemable outcomes but that build towards a final result for a group of tickets.

According to one or more embodiments of the present invention, a lottery product includes a plurality of tickets or other type of game piece, in which each ticket is formatted or designed for use as a game and may also be used for some additional purpose or use. For example, instant scratch games may be provided on media suitable for use as mail pieces, post cards, labels, greeting cards.

According to one embodiment of the present invention, a game or product comprises a plurality of sub-games, wherein each sub-game may or may not be associated with a sub-payout and each sub-payout may be redeemed by one of a sender and a recipient independent of a total redemption value associated with the plurality of sub-games.

One embodiment of the present invention contemplates a booklet comprising a plurality of dual-purpose lottery game cards (e.g., scratch game cards), the first purpose being a lottery game card, and the second purpose being a post card or mailer to be provided by a sender/purchaser to a recipient.

For example, a plurality of such dual-purpose game cards may be created and bound together for sale in booklet form and offered at a predetermined price. For instance, each card may include at least one perforated edge for ease of removal from the booklet. As an example, ten such cards may be created and bound into booklet form and offered for sale for $20. Upon purchase, a purchaser/sender may elect to provide one or more "pages" (i.e. post cards) of the booklet to a recipient.

According to some embodiments, the post card/game card may comprise elements including a first side having scenery, photography, design work, and/or other information disposed thereon. In addition, the post card/game card may include a second side having (among other things) elements useful for facilitating the mailing of the mail piece, including an addressable area, a postage area and a correspondence area. Postage may be but is not necessarily pre-paid.

In addition to the elements described above, a game play area may be included, preferably on the second side. The game play area may include, for example, instant lottery game elements such as symbols or values printed beneath a concealing layer, such as adhesive permeated latex, and may also include applicable rules or other explanations as appropriate for the game.

It is a feature of the post card game provided by the present example that a purchaser/sender may allocate or send individual games of the plurality of games to one or more recipient(s), who may then redeem the game piece/card for any sub-prize associated therewith. For example, a recipient may receive the game piece/card from the purchaser/sender. If the concealing layer has not yet been removed (e.g., by the initial purchaser), the recipient may remove the concealing layer in order to reveal game symbols or values that correspond to available prizes (e.g. cash, credit, merchandise and/or services). If the recipient is determined to have won a prize, the card itself may be presented and redeemed through any of various conventional and other known channels (e.g. at an authorized retailer, via postal mail or web site, etc.) suitable for such a purpose.

In accordance with one embodiment, a feature or aspect is provided whereby a purchaser/sender of the game/post cards may easily discern or determine the redemption value(s) of each game/post card included in the booklet without unnecessarily altering the individual game/post cards themselves. Specifically, a "Sneak Peek" feature is provided that includes alterable (e.g. scratch) areas corresponding to each game/post card included in the booklet (FIG. 1A-23). By removing or otherwise exposing information contained in the "Sneak Peek" area, a purchaser/sender may be able to ascertain the individual redemption value(s) (sub-payouts) of the game/post cards contained in the booklet prior to providing such game/post card(s) to one or more recipient(s). Such a feature may be advantageous in that it may allow a sender/purchaser to exercise discretion or control in providing specific game/post cards to specific recipients.

Another embodiment of the present invention contemplates a booklet comprising a plurality of dual-purpose lottery game cards (e.g. scratch game cards), the first purpose being a lottery game card, and the second purpose being a holiday/event/greeting card to be provided from a sender/purchaser to a recipient.

For example, a plurality of such dual-purpose game cards may be created and bound together for sale in booklet form and offered at a predetermined price. For instance, each card may include at least one perforated edge for ease of removal from the booklet. As an example, four such cards may be created and bound into booklet form and offered for sale for $20. Upon purchase, a purchaser/sender may elect to provide one or more "pages" (e.g., event cards or greeting cards) of the booklet to a recipient.

According to some embodiments, the post card/game card may comprise elements including a first area having scenery, photography, design work, and/or other information disposed thereon, in a manner similar to holiday, event and/or greeting cards (e.g. birthday cards). In addition, the event/game card may include a second area having (among other things) traditional greeting card elements, e.g. a correspondence area, a greeting. An envelope may or may not be provided.

In addition to the elements described above, a game play area may be included, preferably in the second area. Similar to the example of the post card game described above, the game play area may include instant lottery game elements such as symbols or values printed beneath a concealing layer, such as adhesive permeated latex, in addition to applicable rules or other explanations as appropriate for the game.

It is a feature of the game provided by the present example that a purchaser/sender may allocate, send or provide individual games of the plurality to one or more recipient(s), who may then redeem the game piece/card for any sub-prize associated therewith. For example, a recipient may receive the game piece/card from the purchaser/sender. If the concealing layer has not yet been removed (e.g., by the initial purchaser), the recipient may remove the concealing layer in order to reveal game symbols or values that correspond to available prizes (e.g. cash, credit, merchandise and/or services). If the recipient is determined to have won a prize, the card itself may be presented and redeemed through any of various conventional and other known channels (e.g. at an authorized retailer, via postal mail or web site, etc.) suitable for such a purpose.

One example of such an embodiment would provide for printing on respective sides of paper stock or other media, as described with respect to the example of the post card game. Of course, any number of cards, and any number of different types of cards, may be combined in a lottery product.

Similar to the post card game described above, in accordance with one example, a feature or aspect is provided whereby a purchaser/sender of the dual-purpose greeting/game cards may easily discern or determine the redemption value(s) of each greeting/game card included in the booklet without unnecessarily altering the individual greeting/game cards themselves.

In one embodiment, a plurality of dual-purpose game cards may be created and bound together for sale in booklet form and offered at a predetermined price. For instance, each card may include at least one perforated edge for ease of removal from the booklet. As an example, four such cards may be created and bound into booklet form and offered for sale for $20. Upon purchase, a purchaser/sender may elect to provide one or more "pages" (e.g., event cards or greeting cards) of the booklet to a recipient.

Another embodiment of the present invention contemplates a booklet comprising a plurality of dual-purpose lottery game cards (e.g. scratch game cards), the first purpose being a lottery game card, and the second purpose being an adhesive-backed gift label, which may be provided from a purchaser/gift provider to a recipient.

For example, a plurality of such dual-purpose game cards may be created and arranged together for sale in booklet (or other packaging) form and offered at a predetermined price. According to some embodiments, each game/label may include an adhesive backing portion, such that a game/label may be easily affixed to a designated article (e.g. a gift-wrapped package). As an example, ten such games/labels may be created and arranged into booklet and/or folder form (or other packaging) and offered for sale for $20. Upon purchase, a purchaser/sender may elect to provide one or more games/labels to a recipient. The game/label may comprise or include various types of gift label elements including graphics or other designs, and may include a write-in area for designating or identifying a recipient and/or gift provider.

In addition to the elements included on the game/label as described above, a game play area may be included therewith. The game play area may include instant lottery game elements such as symbols or values printed beneath a concealing layer, such as adhesive permeated latex, in addition to applicable rules or other explanations as appropriate for the game.

It is a feature of the game provided by the present example that a purchaser/sender may allocate or send individual games/labels of the plurality to one or more recipient(s), who may then redeem the game/label for any sub-payout associated therewith. For example, a recipient may receive the game/label from the purchaser/sender. If the concealing layer has not yet been removed (e.g., by the initial purchaser), the recipient may remove the concealing layer in order to reveal game symbols or values that correspond to available prizes (e.g. cash, credit, merchandise and/or services). If the recipient is determined to have won a prize, the game/label itself may be presented and redeemed through any of various conventional and other known channels (e.g. at an authorized retailer, via postal mail or web site, etc.) suitable for such a purpose. Similar to the examples discussed above, a feature or aspect is provided whereby a purchaser/sender of the game/label may easily discern or determine the redemption value(s) of each game/label included in the booklet or other packaging without unnecessarily altering the individual game/labels themselves.

Rules of Interpretation

Numerous embodiments have been described, and are presented for illustrative purposes only. The described embodiments are not intended to be limiting in any sense. The invention is widely applicable to numerous embodiments, as is readily apparent from the disclosure herein. These embodiments are described in sufficient detail to enable those skilled in the art to practice the invention, and it is to be understood that other embodiments may be utilized and that structural, logical, software, electrical and other changes may be made without departing from the scope of the present invention. Accordingly, those skilled in the art will recognize that the present invention may be practiced with various modifications and alterations. Although particular features of the present invention may be described with reference to one or more particular embodiments or figures that form a part of the present disclosure, and in which are shown, by way of illustration, specific embodiments of the invention, it should be understood that such features are not limited to usage in the one or more particular embodiments or figures with reference to which they are described. The present disclosure is thus neither a literal description of all embodiments of the invention nor a listing of features of the invention that must be present in all embodiments.

The terms "an embodiment", "embodiment", "embodiments", "the embodiment", "the embodiments", "an embodiment", "some embodiments", "an example embodiment", "at least one embodiment", "one or more embodiments" and "one embodiment" mean "one or more (but not necessarily all) embodiments of the present invention(s)" unless expressly specified otherwise. The terms "including", "comprising" and variations thereof mean "including but not limited to", unless expressly specified otherwise.

The term "consisting of" and variations thereof mean "including and limited to", unless expressly specified otherwise.

The enumerated listing of items does not imply that any or all of the items are mutually exclusive. The enumerated listing of items does not imply that any or all of the items are collectively exhaustive of anything, unless expressly specified otherwise. The enumerated listing of items does not imply that the items are ordered in any manner according to the order in which they are enumerated.

The term "comprising at least one of" followed by a listing of items does not imply that a component or subcomponent from each item in the list is required. Rather, it means that one or more of the items listed may comprise the item specified. For example, if it is said "wherein A comprises at least one of: a, b and c" it is meant that (i) A may comprise a, (ii) A may comprise b, (iii) A may comprise c, (iv) A may comprise a and b, (v) A may comprise a and c, (vi) A may comprise b and c, or (vii) A may comprise a, b and c.

The terms "a", "an" and "the" mean "one or more", unless expressly specified otherwise.

The term "based on" means "based at least on", unless expressly specified otherwise.

The methods described herein (regardless of whether they are referred to as methods, processes, algorithms, calculations, and the like) inherently include one or more steps. Therefore, all references to a "step" or "steps" of such a method have antecedent basis in the mere recitation of the term 'method' or a like term. Accordingly, any reference in a claim to a 'step' or 'steps' of a method is deemed to have sufficient antecedent basis.

Headings of sections provided in this document and the title are for convenience only, and are not to be taken as limiting the disclosure in any way.

Devices that are in communication with each other need not be in continuous communication with each other, unless expressly specified otherwise. In addition, devices that are in communication with each other may communicate directly or indirectly through one or more intermediaries.

A description of an embodiment with several components in communication with each other does not imply that all such components are required, or that each of the disclosed components must communicate with every other component. On the contrary a variety of optional components are described to illustrate the wide variety of possible embodiments of the present invention.

Further, although process steps, method steps, algorithms or the like may be described in a sequential order, such processes, methods and algorithms may be configured to work in alternate orders. In other words, any sequence or order of steps that may be described in this document does not, in and of itself, indicate a requirement that the steps be performed in that order. The steps of processes described herein may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to the invention, and does not imply that the illustrated process is preferred.

It will be readily apparent that the various methods and algorithms described herein may be implemented by, e.g., appropriately programmed general purpose computers and computing devices. Typically a processor (e.g., a microprocessor or controller device) will receive instructions from a memory or like storage device, and execute those instructions, thereby performing a process defined by those instructions. Further, programs that implement such methods and algorithms may be stored and transmitted using a variety of known media.

When a single device or article is described herein, it will be readily apparent that more than one device/article (whether or not they cooperate) may be used in place of a single device/article. Similarly, where more than one device or article is described herein (whether or not they cooperate), it will be readily apparent that a single device/article may be used in place of the more than one device or article.

The functionality and/or the features of a device may be alternatively embodied by one or more other devices which are not explicitly described as having such functionality/features. Thus, other embodiments of the present invention need not include the device itself.

The term "computer-readable medium" as used herein refers to any medium that participates in providing data (e.g., instructions) that may be read by a computer, a processor or a like device. Such a medium may take many forms, including but not limited to, non-volatile media, volatile media, and transmission media. Non-volatile media include, for example, optical or magnetic disks and other persistent memory. Volatile media may include dynamic random access memory (DRAM), which typically constitutes the main memory. Transmission media may include coaxial cables, copper wire and fiber optics, including the wires or other pathways that comprise a system bus coupled to the processor. Transmission media may include or convey acoustic waves, light waves and electromagnetic emissions, such as those generated during radio frequency (RF) and infrared (IR) data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, a carrier wave as described hereinafter, or any other medium from which a computer can read.

Various forms of computer readable media may be involved in carrying sequences of instructions to a processor. For example, sequences of instruction (i) may be delivered from RAM to a processor, (ii) may be carried over a wireless transmission medium, and/or (iii) may be formatted according to numerous formats, standards or protocols, such as Transmission Control Protocol, Internet Protocol (TCP/IP), Wi-Fi, Bluetooth, TDMA, CDMA, and 3G.

Where databases are described, it will be understood by one of ordinary skill in the art that (i) alternative database structures to those described may be readily employed, and (ii) other memory structures besides databases may be readily employed. Any schematic illustrations and accompanying descriptions of any sample databases presented herein are illustrative arrangements for stored representations of information. Any number of other arrangements may be employed besides those suggested by the tables shown. Similarly, any illustrated entries of the databases represent exemplary information only; those skilled in the art will understand that the number and content of the entries can be different from those illustrated herein. Further, despite any depiction of the databases as tables, other formats (including relational databases, object-based models and/or distributed databases) could be used to store and manipulate the data types described herein. Likewise, object methods or behaviors of a database can be used to implement the processes of the present invention. In addition, the databases may, in a known manner, be stored locally or remotely from a device that accesses data in such a database.

It should also be understood that, to the extent that any term recited in the claims is referred to elsewhere in this document in a manner consistent with a single meaning, that is done for the sake of clarity only, and it is not intended that any such term be so restricted, by implication or otherwise, to that single meaning. Finally, unless a claim element is defined by reciting the word "means" and a function without reciting any structure, it is not intended that the scope of any claim element be interpreted based on the application of 35 U.S.C. §112, sixth paragraph.

Although the present invention has been described with respect to preferred embodiments thereof, those skilled in the art will note that various substitutions and modifications may be made to those embodiments described herein without departing from the spirit and scope of the present invention.

What is claimed is:

1. A method for producing a lottery product providing a story, the method comprising:

printing a first page that embodies a first instant game, the first page including a first removable covering concealing a first element of a story, and the first page being associated with a first predetermined sub-payout, and the first page indicating a first predetermined running value of the lottery product;

printing a second page that embodies a second instant game, the second page including a second removable covering concealing a second element of the story, and the second page being associated with a second predetermined sub-payout, and the second page indicating a second predetermined running value of the lottery product, the second predetermined running value being based on the first predetermined sub-payout and the second predetermined sub-payout;

printing a table that (1) identifies a third element of the story and indicates a first potential prize for the first instant game if the third element matches the first element and (2) identifies a fourth element of the story and indicates a second potential prize for the second instant game if the fourth element matches the second element; and assembling the first page, the second page, and the table into a lottery product.

2. The method of claim 1, in which the first element comprises at least one word.

3. The method of claim 1, in which the first removable covering conceals a plurality of text elements.

4. The method of claim 1, in which the first removable covering conceals first dialog for the story.

5. The method of claim 1, in which the first removable covering conceals a representation of at least one character in the story.

6. The method of claim 1, in which the story comprises historical information.

7. The method of claim 1, in which the story comprises educational information.

8. The method of claim 1, in which the story comprises safety information.

9. The method of claim 1, in which the story comprises tourism information.

10. The method of claim 1, in which the first predetermined sub-payout is a negative value, and the second predetermined sub-payout is not a negative value.

11. The method of claim 1, in which the first predetermined subpayout is different than the second predetermined payout.

12. The method of claim 1, in which the first page is embodied in a lottery ticket.

13. The method of claim 1, in which assembling comprises:

packaging the first page, the second page, and the table in a common container.

14. The method of claim 1, in which assembling comprises:

assembling the first page, the second page, and the table as a book.

15. The method of claim 1, in which the lottery product comprises a graphic novel.

16. The method of claim 1, in which the story is at least partially illustrated.

17. The method of claim 1, in which printing the table comprises:

determining a plurality of different tables associated with the story; and selecting one of the plurality of tables.

18. The method of claim 17, in which selecting comprises:

randomly selecting one of the plurality of tables.

19. The method of claim 17, in which the third element comprises dialog spoken by a specific story character, and in which at least two of the plurality of tables differ with respect to which story character speaks the dialog.

20. The method of claim 17, in which at least two of the plurality of tables differ in the value of the first potential prize.

21. The method of claim 1, in which the third element is the same as the fourth element.

22. The method of claim 1, further comprising:

assembling a second lottery product comprising a third page identical to the first page of the lottery product, a fourth page identical to the second page of the lottery product, and a respective table that is different than the table of the lottery product.

23. The method of claim 1, in which the third element comprises first dialog spoken by a story character, and the table indicates the first potential prize for the first instant game if the first element comprises the first dialog spoken by the story character, the method further comprising:

assembling a second lottery product comprising (1) a respective first page that is identical to the first page of the lottery product, and (2) a respective table, in which the table indicates a respective third element comprises second dialog spoken by the story character, the second dialog being different than the first dialog.

24. The method of claim 1, in which the lottery product embodies an illustrated story, the illustrated story comprising illustrations and first dialog by a story character, the method further comprising:

assembling a second lottery product comprising the identical illustrations and second dialog by the story character that is different than the first dialog.

25. The method of claim 1, in which an occurrence of a story element anywhere in the lottery product corresponds to a bonus payout.

26. The method of claim 25, in which the story element comprises at least one of the following types of elements:

a phrase, a type of phrase, a prop, a type of prop, and an event.

27. The method of claim 1, in which the story comprises at least one of the following:

play of a sports game, an adventure story, a plurality of races, and a journey.

28. A story product comprising:

a plurality of instant scratch-off games assembled as a book, each instant scratch-off game comprising a respective covering element that conceals respective revealable dialog of a story, in which each instant scratch-off game is embodied in a respective page of the book, in which at least one page of the book includes a predetermined running value for the story product, the respective running value being based on at least two predetermined running values on respective preceding pages of the book; and a paytable for the book, the paytable indicating respective winning dialog for each of the plurality of instant scratch-off games.

29. The story product of claim 28, in which the paytable is embodied in the book.

30. The story product of claim 28, in which the paytable is physically separate from the book.

31. The story product of claim 28, in which the paytable is detachably removable from at least one of the instant games.

32. The story product of claim 28, in which the paytable indicates, for each instant scratch-off game, a respective payout redeemable if the respective winning dialog matches the respective revealable dialog for the instant scratch-off game.

* * * * *